US011560251B2

(12) United States Patent
Darby

(10) Patent No.: US 11,560,251 B2
(45) **Date of Patent: *Jan. 24, 2023**

(54) SHIPPING CONTAINER AND METHOD OF FOLDING A SHIPPING CONTAINER

(71) Applicant: New-Indy TriPAQ LLC, Cerritos, CA (US)

(72) Inventor: Michael Kiyoshi Darby, Seal Beach, CA (US)

(73) Assignee: New-Indy TriPAQ LLC, Cerritos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/340,813

(22) Filed: Jun. 7, 2021

(65) Prior Publication Data

US 2021/0292039 A1 Sep. 23, 2021

Related U.S. Application Data

(63) Continuation of application No. 16/286,117, filed on Feb. 26, 2019, now Pat. No. 11,027,876.

(51) Int. Cl.

| | |
|---|---|
| ***B65D 5/02*** | (2006.01) |
| ***B65D 81/05*** | (2006.01) |
| ***B65D 85/30*** | (2006.01) |

(52) U.S. Cl.

CPC ..... *B65D 5/0227* (2013.01); *B65D 81/055* (2013.01); *B65D 85/305* (2013.01); *B65D 2581/053* (2013.01)

(58) Field of Classification Search

CPC .... B65D 5/443; B65D 5/6638; B65D 5/6644; B65D 5/0004; B65D 5/5011; B65D 5/0281; B65D 85/305; B65D 81/053–056; B65D 2581/053

USPC ..... 229/122.32–122.34, 125.19–125.21, 229/135.32, 141–143, 152, 154, 185.1, 229/147, 174, 919

See application file for complete search history.

(56) References Cited

U.S. PATENT DOCUMENTS

| | | | | |
|---|---|---|---|---|
| 2,341,928 | A | 2/1944 | Levkoff | |
| 2,474,523 | A | 6/1949 | Guyer | |
| 2,685,400 | A * | 8/1954 | MacArthur, Jr. ..... | B65D 5/541 229/222 |
| 3,361,324 | A | 1/1968 | Crisafulli | |
| 4,245,772 | A | 1/1981 | Johnson | |
| 5,720,390 | A | 2/1998 | Bostelman | |
| 8,573,472 | B2 | 11/2013 | Block | |
| 8,584,928 | B2 * | 11/2013 | Keissner ..... | B65D 5/5004 229/160 |

(Continued)

*Primary Examiner* — Nathan J Newhouse
*Assistant Examiner* — Phillip D Schmidt
(74) *Attorney, Agent, or Firm* — Lando & Anastasi, LLP

(57) ABSTRACT

A foldable container blank includes at four side walls, a top panel foldably connected to one of the side walls, a bottom panel foldably connected to one of the side walls, and at least one internal support structure that is connected to one of the side walls. Each internal support structure includes a first portion that is in adjacent relation with the top panel when the container is in a closed condition, and a second portion that is in adjacent relation with the first portion when the container is in a closed condition. In some embodiments, the foldable container blank is integrally formed. A method of forming the foldable container blank and a method of folding a container blank are also provided.

19 Claims, 20 Drawing Sheets

(56) References Cited

U.S. PATENT DOCUMENTS

| | | | | |
|---|---|---|---|---|
| 11,027,876 | B2 * | 6/2021 | Darby | B65D 5/0227 |
| 2010/0155290 | A1 * | 6/2010 | Kiessner | B65D 5/5004<br>206/586 |
| 2014/0197230 | A1 * | 7/2014 | Lopez Masague | B65D 5/10<br>229/123.2 |

* cited by examiner

SHIPPING CONTAINER AND METHOD OF FOLDING A SHIPPING CONTAINER

CROSS-REFERENCE TO RELATED APPLICATION

This application is a continuation of U.S. patent application Ser. No. 16/286,117, filed on Feb. 26, 2019, titled "SHIPPING CONTAINER AND METHOD OF FOLDING A SHIPPING CONTAINER," which is hereby incorporated by reference herein in its entirety.

BACKGROUND OF THE DISCLOSURE

The present disclosure relates generally to shipping containers for shipping products to consumers.

Some shipping companies and other organizations have standards with which product packaging must comply. For example, the International Safe Transit Association (ISTA) develops testing protocols and design standards for packaging to ensure that packaging protects the products that are transported within the packaging. Some members of the ISTA create their own test protocols based on their own standards for product packaging. These member-created standards may be based on things such as customer feedback, studies of product packaging, and/or shipping challenges. For example, Amazon has created "Project 6-AMAZON.COM-SIOC, Ships in Own Container (SIOC) for Amazon.com Distribution System Shipment." An item that is compliant under Type A of this standard is an individually packaged product that meets the testing requirements, is less than 50 pounds, and is less than 165 inches in girth.

SUMMARY

According to one aspect of the present disclosure, a foldable container blank comprises four side walls; a top panel foldably connected to one of the side walls; a bottom panel foldably connected to one of the side walls; and at least one internal support structure connected to one of the side walls and including a first portion that is in adjacent relation with the top panel when the container is in a closed condition, and a second portion that is in adjacent relation with the first portion when the container is in the closed condition.

In some embodiments, the first portion is between the second portion and the top panel when the container is in the closed condition.

In some embodiments, each internal support structure includes at least one leaf secured to an edge of the second portion, the leaf being in adjacent relation with one of the side walls when the container is in the closed condition.

In some embodiments, the at least one internal support structure includes a first internal support structure and a second internal support structure each secured to one of the side walls, and a third internal support structure and a fourth internal support structure each secured to another one of the side walls.

In some embodiments, each internal support structure includes at least one leaf secured to an edge of the second portion, the leaf being in adjacent relation with one of the side walls when the container is in the closed condition.

In some embodiments, each internal support structure includes a first leaf secured to a first edge of the second portion, the first leaf being in adjacent relation with a first side wall of the four side walls when the container is in the closed condition, and a second leaf secured to a second edge of the second portion, the first edge being opposite the second edge, the second leaf being in adjacent relation with a third side wall of the four side walls, the third side wall being opposite the first side wall when the container is in the closed condition. In some embodiments, the side walls, the top panel, the bottom panel, and the one internal support structures are formed of a single piece of material.

In some embodiments, the side walls, the top panel, the bottom panel, and the at least one internal support structure are formed of a single piece of material. In some embodiments, the single piece of material has a substantially rectangular shape when unfolded.

In some embodiments, the top panel includes a notch.

In some embodiments, the container blank further comprises an external top panel that folds over the top panel when the container is the closed condition.

In some embodiments, the container blank further comprises an external bottom panel that folds beneath the bottom panel when the container is in the closed condition.

In some embodiments, the container blank further comprises a tab connected to one of the side walls, the tab being securable to another one of the side walls when the container is in the closed condition.

According to another aspect of the present disclosure, a method of forming a container blank includes cutting a piece of material to have four side walls; a top panel foldably connected to a first one of the side walls; a bottom panel foldably connected to the first one of the side walls; at least one internal support structure connected to a second one of the side walls and including a first portion that is in adjacent relation with the top panel when the container is in a closed condition, and a second portion that is in adjacent relation with the first portion when the container is in the closed condition.

In some embodiments, the method further comprises creasing an edge between the top panel and the first one of the side walls; creasing an edge between the bottom panel and the first one of the side walls; and creasing an edge between the at least one internal support structure and the second one of the side walls.

According to another aspect of the present disclosure, a method of assembling a foldable container comprises folding four side walls so the four side walls have a substantially square arrangement when viewed from above; folding a bottom panel that is foldably connected to a first one of the side walls so that the bottom panel is perpendicular to the first one of the side walls; and folding at least one internal support structure connected to a second one of the side walls and folding a top panel that is connected to the first one of the side walls so that a first portion of the at least one internal support structure is in adjacent relation with the top panel when the container is in a closed condition a second portion of the at least one internal support structure is in adjacent relation with the first portion when the container is in the closed condition.

According to another aspect of the present disclosure, a shipping container fabricated from cardboard material is provided, and the container comprises a first side wall having at least two layers of cardboard material; a second side wall having at least two layers of cardboard material; a third side wall; a fourth side wall; a top wall having at least four layers of cardboard material; and a bottom wall having at least four layers of cardboard material, wherein the container including the first side wall, the second side wall, the third side wall, the fourth side wall, the top wall, and the bottom wall is formed from a unitary blank.

In some embodiments, the four layers of the top wall include an external top wall; an internal top wall; and a first internal support structure having two walls. In some embodiments, the four layers of the bottom wall include an external bottom wall; an internal bottom wall; and a second internal support structure having two walls.

In some embodiments, the two walls of the first internal support structure are joined at a first foldable edge, and the two walls of the second internal support structure are joined at a second foldable edge.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

The present disclosure provides container blank that can be folded to form a shipping container that is complaint with Type A testing under the Project 6-AMAZON.COM-SIOC standard and other testing standards.

Container blanks of the present disclosure can be folded into the shape of a container that provides multi-wall protection. For example, a container blank of the present disclosure may form a container that has four layers of material of the container blank that extend vertically through at least a portion of the container (two layers or walls on one side and two layers or walls on the opposite side) and eight layers of material of the container blank that extend horizontally through at least a portion of the container (four layers or walls on the top and four layers or walls on the bottom).

Methods of the present disclosure efficiently use stock material to form the container blank. Such container blanks can be stacked and shipped to vendors, where the blanks are folded and assembled to form containers, which can be filled with products.

Each container blank can be folded to form a container that is suitable for shipping items such as aluminum cans or plastic bottles containing liquids. In some embodiments, the cans or bottles each have a volume between 8 fluid ounces and 24 fluid ounces.

Figure 1:
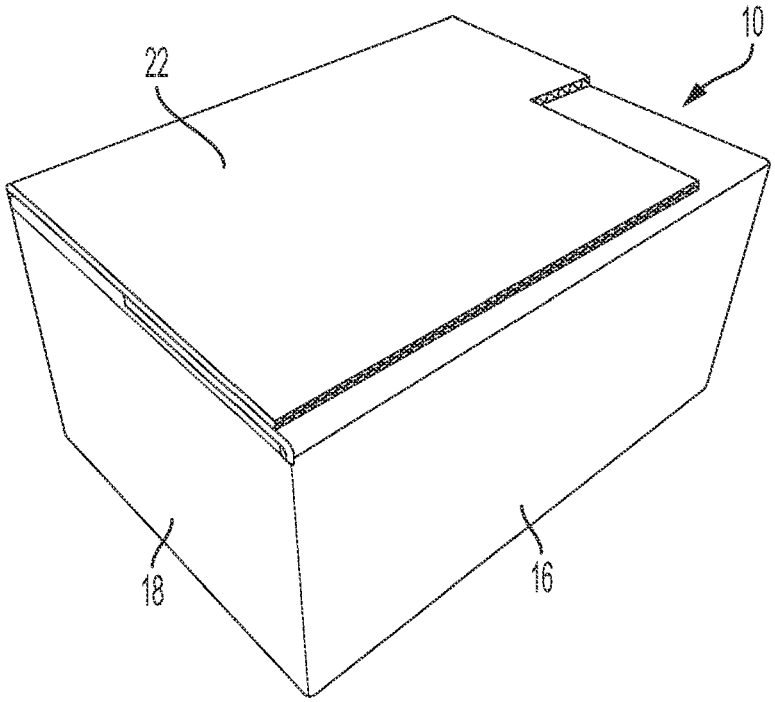
FIG. 1 is a perspective view of a shipping container according to the present disclosure in a fully assembled, closed condition.
Figure 2:
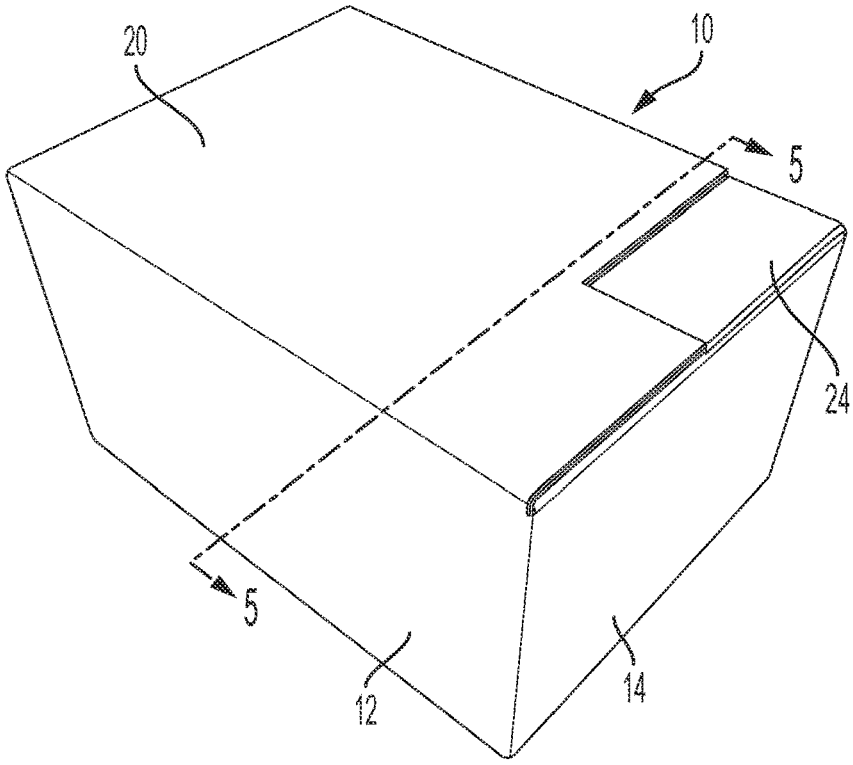
FIG. 2 is another perspective view thereof.
Figure 6:
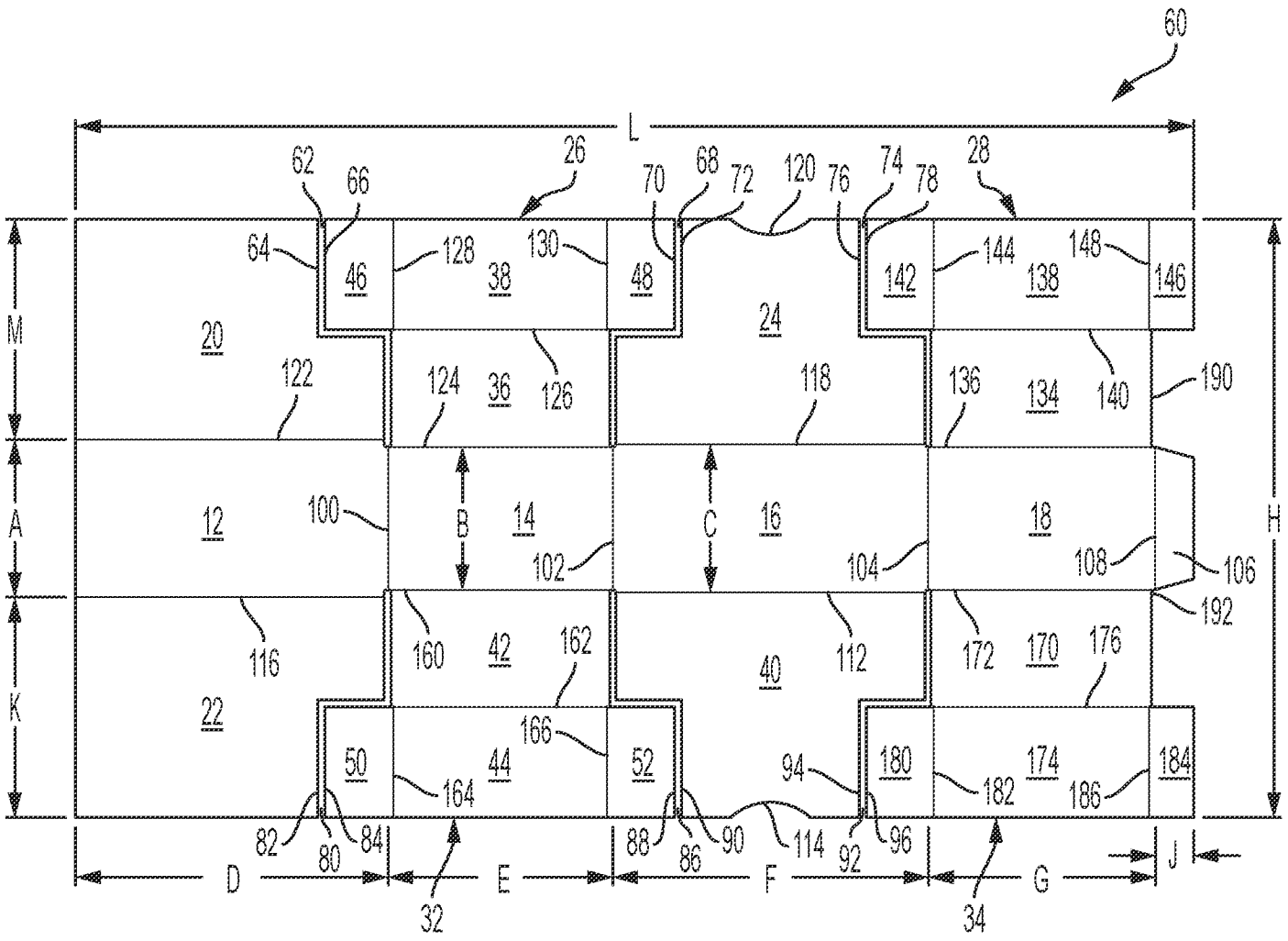
FIG. 6 is plan view of an embodiment of a container blank according to the present disclosure.

FIGS. 1-4B illustrate a shipping container, generally indicated at 10, that is formed from a container blank according to the present disclosure, such as the container blank 60 of FIG. 6. The container 10 has a first side wall 12, a second side wall 14, a third side wall 16, a fourth side wall 18, an external top wall 20, and an external bottom wall 22. In FIG. 1, the container 10 is shown with the external bottom wall 22 taped to the third side wall 16 and the fourth side wall 18. In FIG. 2, the container 10 is shown with the external top wall 20 taped to the first side wall 12 and the second side wall 14. When the container 10 is in the closed condition of FIG. 2, the external top wall 20 extends over an internal top wall 24.

Figure 3:
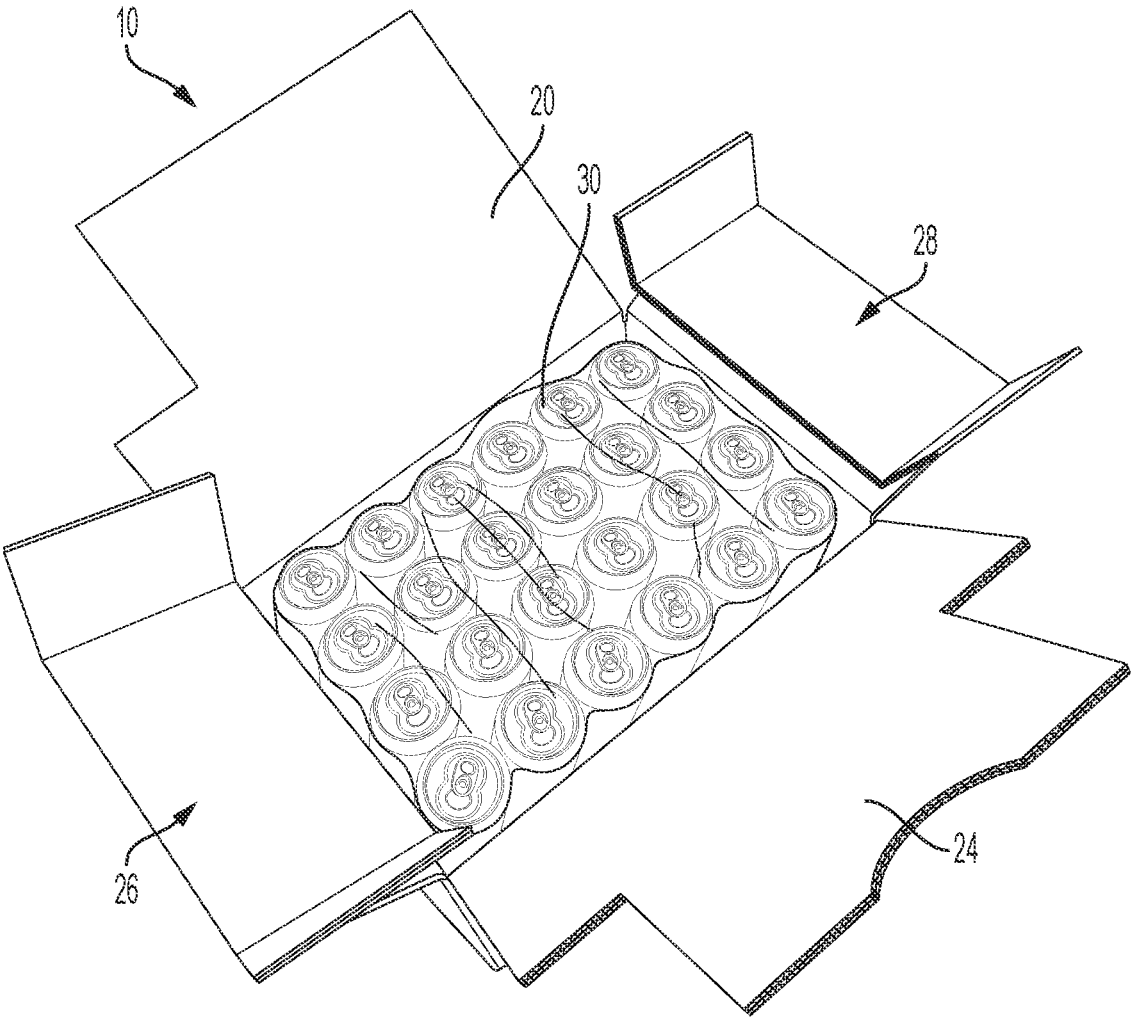
FIG. 3 is a perspective view of the container of FIG. 1 in an open condition.

In FIG. 3, the container 10 is shown in an open condition in which the external top wall 20 and the internal top wall 24 have been unfolded to expose a first internal support structure, indicated generally at 26, and a second internal support structure, indicated generally at 28, which help secure a product 30 within the container 10 when the container 10 is in the closed condition. In one example, the container 10 is dimensioned and configured to snugly and securely transport a 24-pack of cans or bottles that contain a beverage.

Figure 4A:
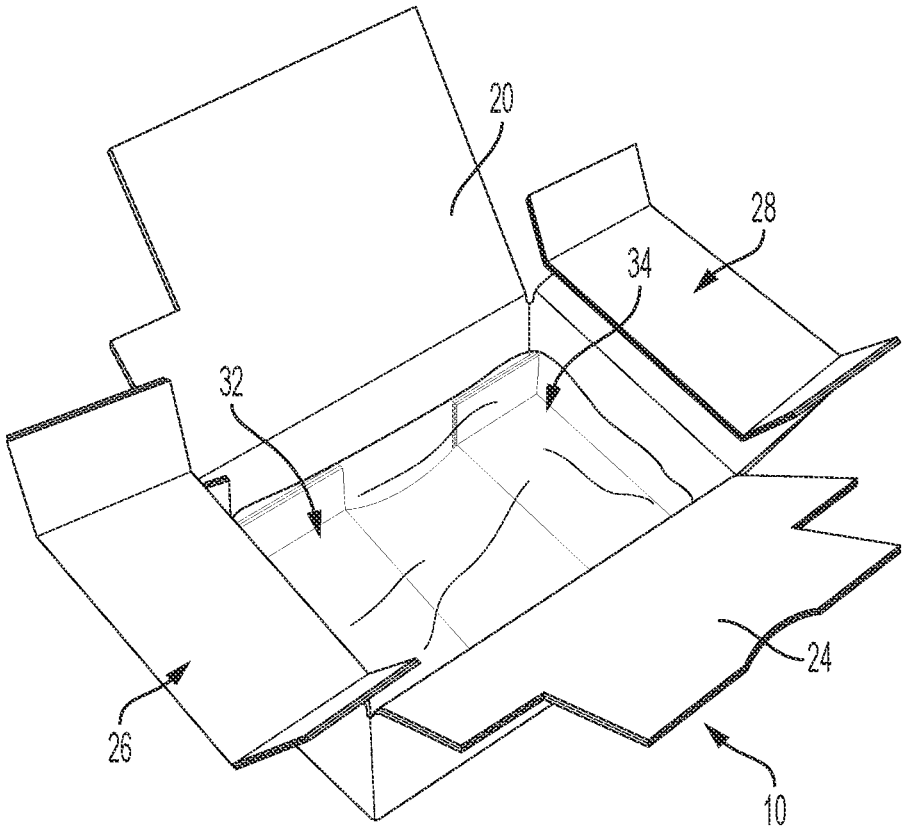
FIG. 4A is a perspective view of the container of FIG. 3 with a product removed from the container.
Figure 4A:
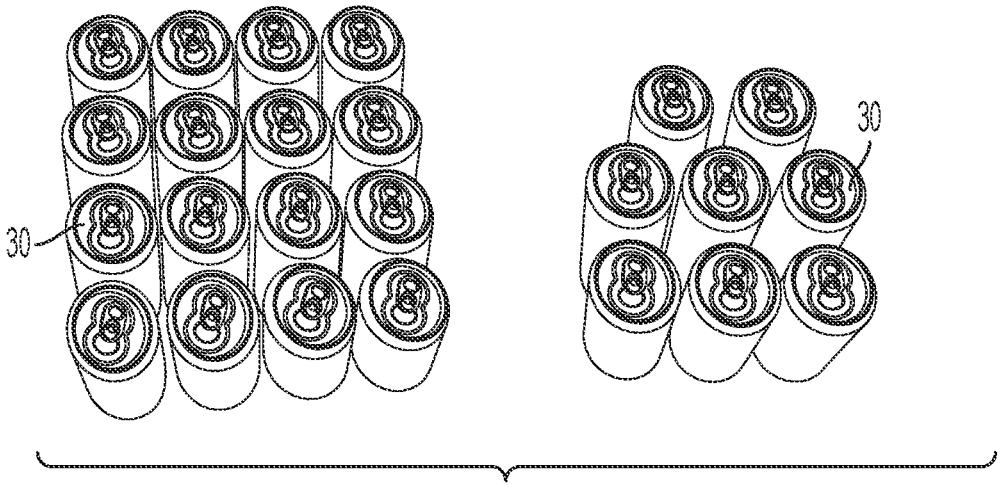
Figure 4B:
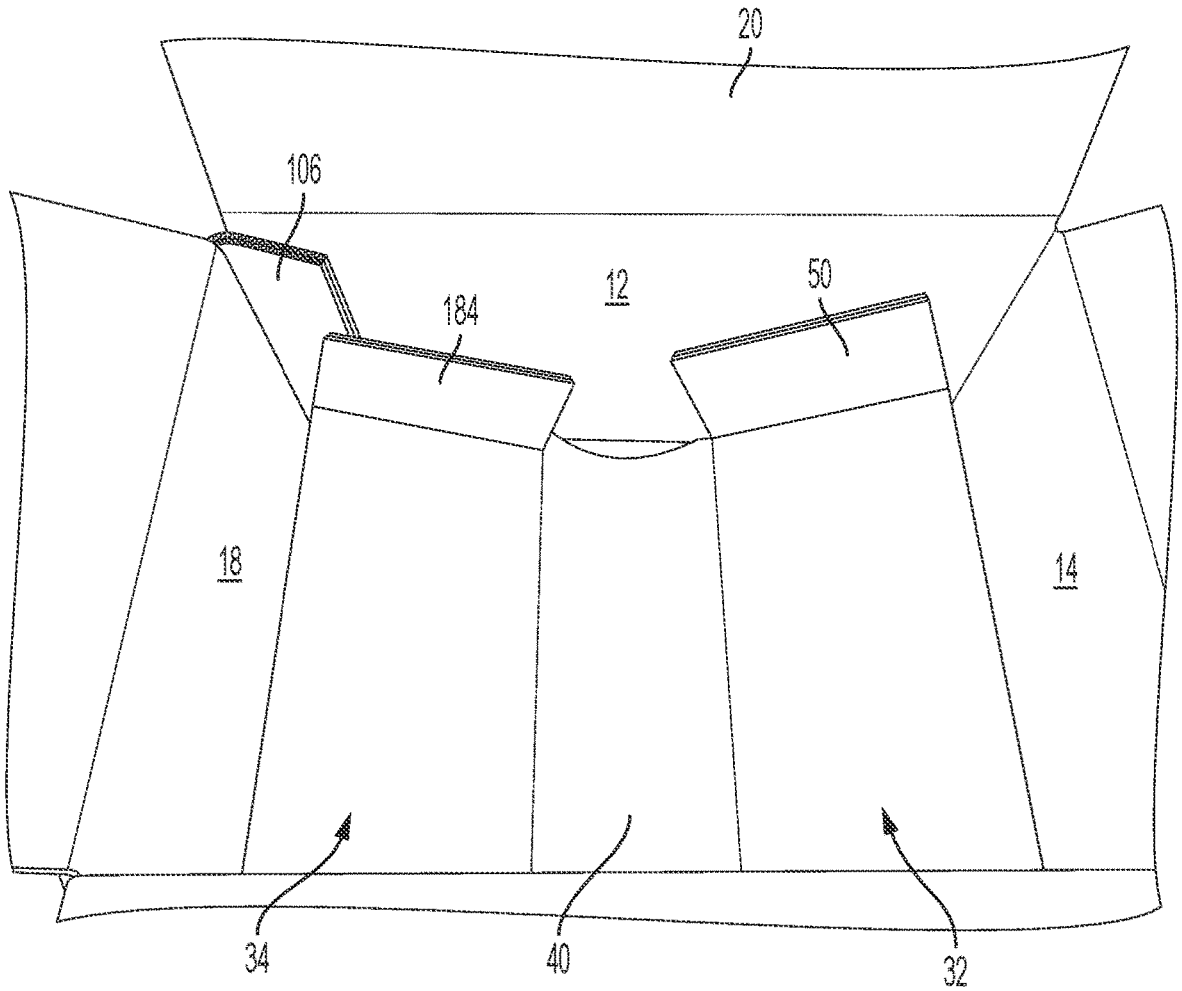
FIG. 4B is another perspective view of the container of FIG. 4A.

In FIG. 4A, the product 30 has been removed from the container, showing that the container 10 successfully protected the product 30 from damage during shipment of the container 10. In FIG. 4B, a third internal support structure 32 and a fourth internal support structure 34 are visible toward the lower end of the container 10. The third internal support structure 32 and the fourth internal support structure 34 are partially obscured in FIG. 4A.

Figure 5:
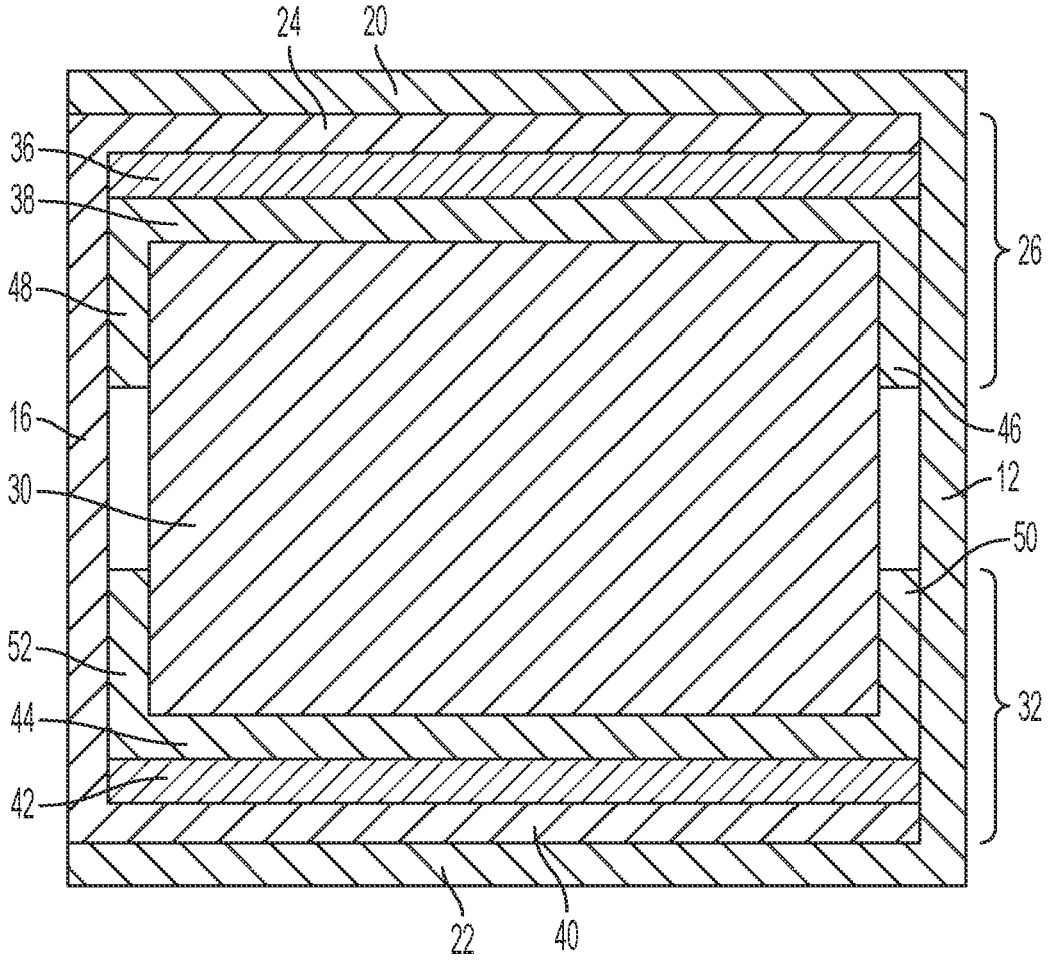
FIG. 5 is a view of FIG. 2 through the section line 5-5.

In FIG. 5, the container 10 is configured to effectively provide four layers of container blank material in a lateral or horizontal direction (two layers or walls for each side) and eight layers of container blank material in a vertical direction (four layers or walls for the top and four layers or walls for the bottom).

Four horizontal walls are configured to extend over the upper end of the product 30. The uppermost wall of the container 10 is the external top wall 20. Beneath the external top wall 20 is the internal top wall 24. Beneath the internal top wall 24 is the first internal support structure, generally indicated at 26. A first portion 36 and a second portion 38 of the first internal support structure 26 extend horizontally beneath the internal top wall 24. The first portion 36 of the first internal support structure 26 is a wall that is adjacent the internal top wall 24. The second portion 38 of the first internal support structure 26 is a wall that is configured to face the product 30 within the container 10. When a product 30 is placed within the container, and the container 10 is in a closed condition, a lower surface of the second portion 38 of the first internal support structure 26 is in facing relation with the product 30.

Four horizontal walls are configured to extend beneath the lower end of the product 30. The lowermost wall of the container 10 is the external bottom wall 22. Above the external bottom wall 22 is the internal bottom wall 40. Above the internal bottom wall 40 is the third internal support structure, generally indicated at 32. A first portion 42 and a second portion 44 of the third internal support structure 32 extend horizontally above the internal bottom wall 40. The first portion 42 of the third internal support structure 32 is a wall that is adjacent the internal bottom wall 40. The second portion 44 of the third internal support structure 32 is a wall that is configured to face the product 30 within the container 10. When the product 30 is placed in the container 10, an upper surface of the second portion 44 of the third internal support structure 32 is in facing relation with the product 30. As shown in FIG. 5, the product 30 is seated on the third internal support structure 32.

To provide lateral support, a first leaf 46 and a second leaf 48 depend downwardly from the second portion 38 of the first internal support structure 26. The first leaf 46 is adjacent the first side wall 12 and the second leaf 48 is adjacent the third side wall 16 when the container 10 is in the closed condition. The third support structure 32 includes a first leaf 50 and a second leaf 52 that extend upwardly from the second portion 44 of the third internal support structure 32. The first leaf 50 is adjacent the first side wall 12 and the second leaf 52 is adjacent the third side wall 16 when the container 10 is in the closed condition. Thus, the container 10 has two walls on either side of the product 30, for a total of four walls in the lateral or horizontal direction.

The container 10 of FIGS. 1-5 may be folded from a single, unitary container blank. FIG. 6 shows one embodiment of a substantially flat container blank, indicated generally at 60, according to the present disclosure. FIG. 6 shows surfaces of the container blank 60 that may become internal surfaces of the container 10 when the container blank 60 is folded to form the container 10. In some embodiments, the blank may be folded in a reverse manner so external surfaces of the container are formed from some of the surfaces visible in FIG. 6. The container blank 60 has a substantially rectangular shape when in the substantially flat, unfolded condition. Because the container blank 60 is at least substantially flat, the container blank 60 may be provided, for example, in a stack of identically formed or substantially similarly formed container blanks that can then each be folded by a user to form a respective container.

The container blank 60 may be integrally formed from a single piece of material. In some embodiments, the container blank 60 is formed from a single piece of cardboard. In some embodiments, the container blank 60 is formed from a single piece of cardboard and/or another material suitable to form a container. In some embodiments, the cardboard is a corrugated cardboard, such as a single layer corrugated cardboard (a 3-ply corrugated linerboard and medium), a double layer corrugated cardboard (a 5-ply corrugated linerboard and medium), or another corrugated cardboard, as discussed below.

In FIG. 6, in one embodiment, the container blank 60 is formed from a single piece of material that has an overall height H of 30.875 inches and an overall length L of 57.8125 inches. As will be described further herein, slots separate portions of the blank that will become sections of a fully formed container, such as the internal top wall 24, the external top wall 20, the first internal support structure 26, and the second internal support structure 28. A first slot 62 is defined between a lateral edge 64 of the external top wall 20 and a first lateral edge 66 of the first internal support structure 26. A second slot 68 is defined between a second lateral edge 70 of the first internal support structure 26 and a first lateral edge 72 of the internal top wall 24. A third slot 74 is defined between a second lateral edge 76 of the internal top wall 24 and a lateral edge 78 of the second internal support structure 28. Slots also separate the internal bottom wall 40, the external bottom wall 22, the third internal support structure 32, and the fourth internal support structure 34. A fourth slot 80 is defined between a lateral edge 82 of the external bottom wall 22 and a first lateral edge 84 of the third internal support structure 32. A fifth slot 86 is defined between a second lateral edge 88 of the third internal support structure 32 and a first lateral edge 90 of the internal bottom wall 40. A sixth slot 92 is defined between a second lateral edge 94 of the internal bottom wall 40 and a lateral edge 96 of the fourth internal support structure 34.

The container blank 60 of FIG. 6 includes four segments that are designated as the four side walls of the container 10. The first side wall 12, the second side wall 14, the third side wall 16, and the fourth side wall 18 are provided in a linear arrangement on the container blank 60 and are connected by foldable edges. The first side wall 12 is connected to the second side 14 wall by a foldable edge 100. The second side wall 14 is a connected to the third side wall 16 by a foldable edge 102. The third side wall 16 is connected to the fourth side 18 wall by a foldable edge 104.

Figure 8:
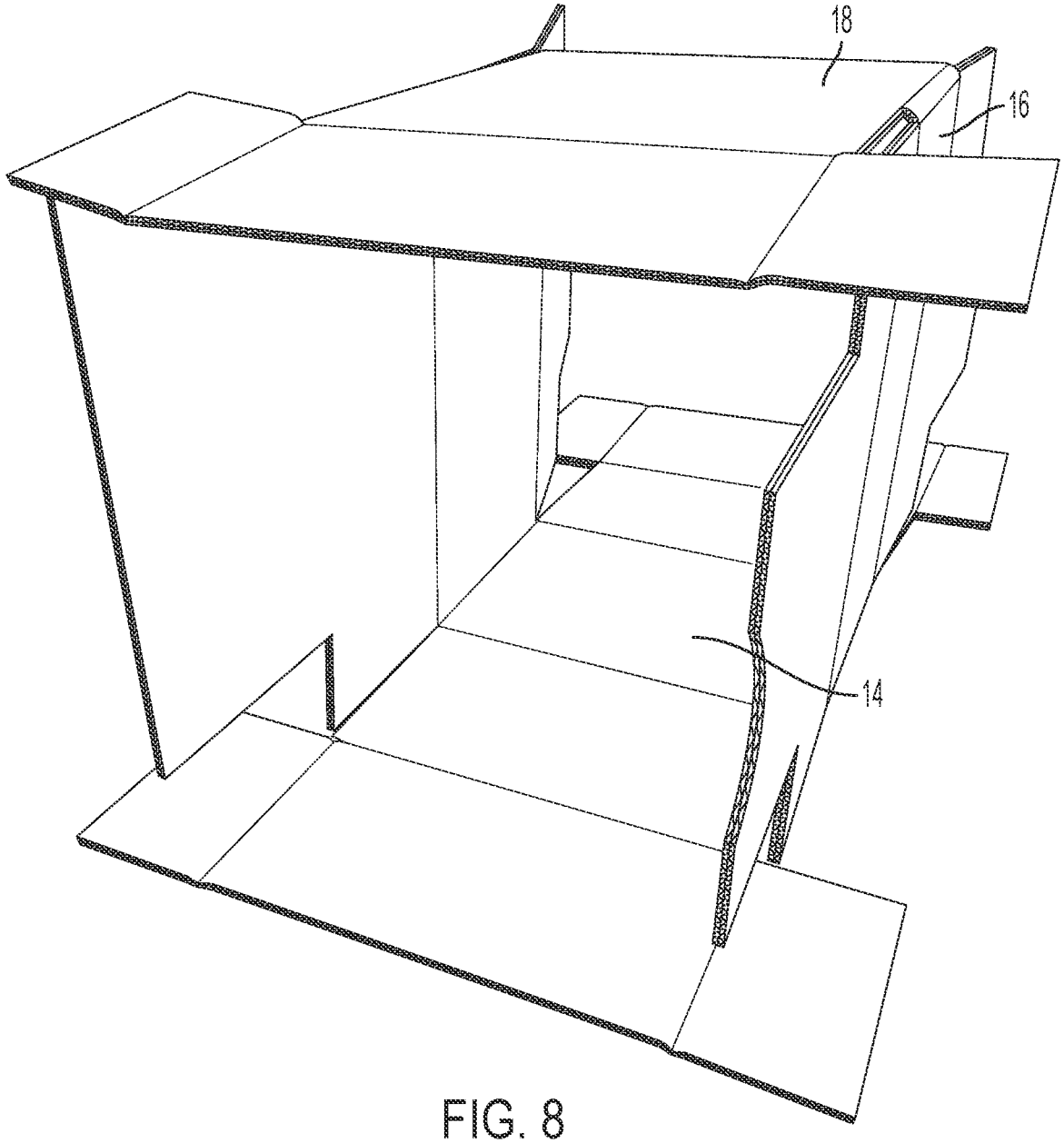
FIG. 8 is a perspective view of another step of forming a container from the container blank of FIG. 7.
Figure 9:
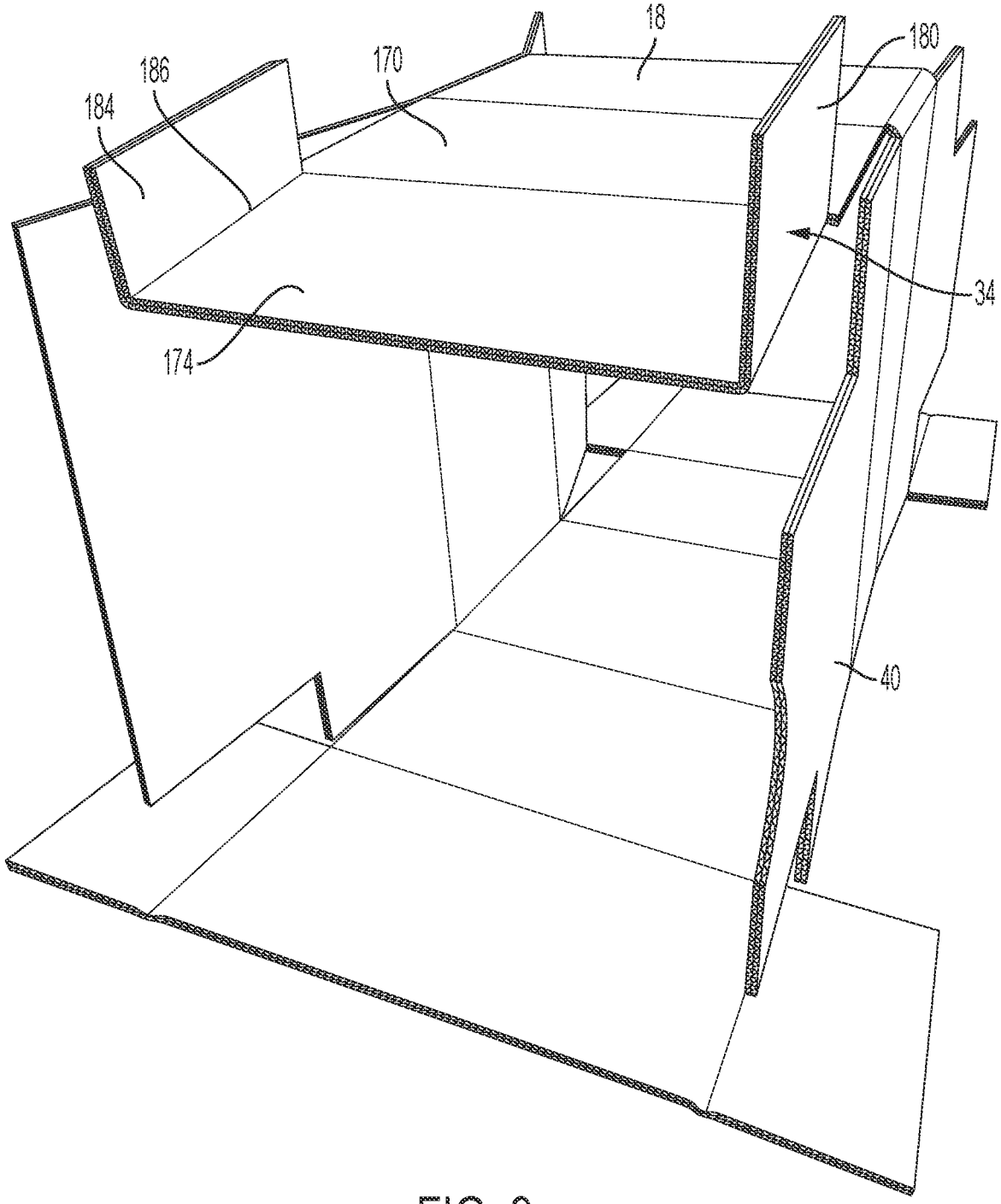
FIG. 9 is a perspective view of another step of forming a container from the container blank of FIG. 7.

The foldable edges 100, 102, 104 that are between the side walls 12, 14, 16, 18 allow a user to fold the side walls 12, 14, 16, 18 with respect to each other so that the side walls 12, 14, 16, 18 together form a substantially square arrangement when viewed from above or below as shown in FIG. 8.

In the shown embodiment, the dimensions of the side walls 12, 14, 16, 18 may be selected based on the desired container dimensions. In the exemplary embodiment of FIG. 6, the first side wall 12 has a height of A of 8.25 inches, the second side wall 14 has a height B of 7.5 inches, the third side wall 16 has a height C of 7.875 inches, and fourth side wall 18 has a height B of 7.5 inches. In the exemplary embodiment of FIG. 6, the first side wall 12 has a length D of 16.125 inches, the second side wall 14 has a length of E 11.6875 inches, the third side wall 16 has a length F of 16.3125 inches, and the fourth side wall 18 has a length G of 11.6875 inches. In other embodiments, different dimensions may be used to accommodate different products or different types of products disposed in the container.

Figure 7:
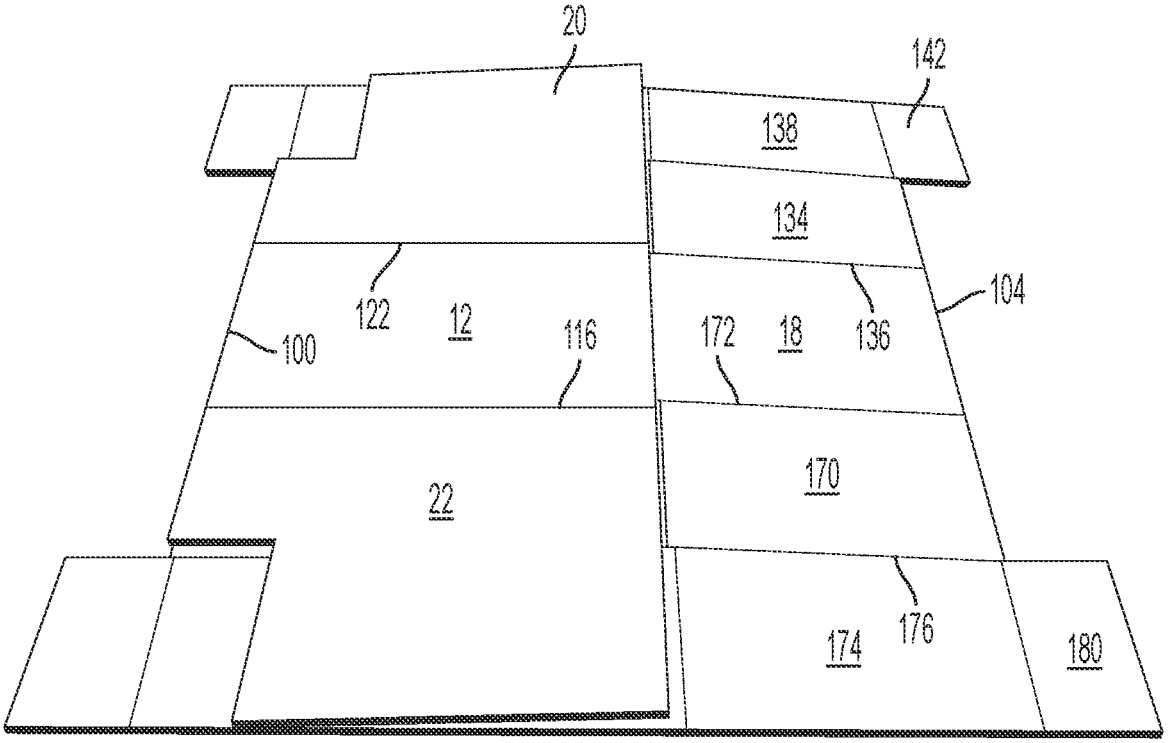
FIG. 7 is a perspective view of a step of folding a container blank to form a container.

A tab 106 is provided to connect the fourth side wall 18 to the first side wall 12 when the container is in a closed condition. The fourth side wall 18 is connected by a foldable edge 108 to the tab 106. The tab 106 is securable to the first side wall 12 so that the four side walls 12, 14, 16, 18 form a perimeter of a container 10. For example, the tab 106 may be secured to the first side wall 12 by an adhesive, one or more staple, tape, or another fastener. FIG. 7 shows the container blank 60 when the tab 106 is secured to the first side wall 12.

In FIG. 6, the tab 106 has a length J of 2 inches, and an overall height B of 7.5 inches. In other embodiments, the tab 106 may have other dimensions. In FIG. 6, the tab 106 has a trapezoidal shape. In some embodiments, the tab 106 may have another shape. The tab 106 is configured to have a sufficiently large surface area to be fastened to a surface of the first side wall 12 so that the structural integrity of the container is maintained during shipping and handling of the container.

As discussed, to form a bottom of the container, the container blank 60 includes the internal bottom panel 40 and the external bottom panel 22. The internal bottom panel 40 is connected by a foldable edge 112 to the third side wall 16. In the event that a user opens the container from the bottom, the internal bottom panel 40 includes a notch 114 along a free edge of the internal bottom panel 40 that allows a user to more easily grip the internal bottom panel 40 and rotate the internal bottom panel 40 along a fold line so that the internal bottom panel 40 is parallel to the third side wall 16. Then the user can remove contents from the container. In the embodiment of FIG. 6, the internal bottom panel 40 has an overall width of slightly less than 16.3125 inches due to material being removed from the blank 60 to form the internal bottom panel 40, and an overall depth K of 11.3125 inches.

The external bottom panel 22 is connected by a foldable edge 116 to the first side wall 12. The external bottom panel 22 may be folded beneath the internal bottom panel 40, and the internal bottom panel 40 and external bottom panel 22 are substantially perpendicular to the side walls 12, 14, 16, 18 when the container is in the closed condition. In the embodiment of FIG. 6, the external bottom panel 22 has an overall width of slightly less than 16.125 inches due to material being removed from the blank to form slots that define the external bottom panel 22, and an overall depth K of 11.3125 inches.

As discussed, to form a top of the container 10, the container blank 60 includes the internal top panel 24 and the external top panel 20. The internal top panel 24 is connected by a foldable edge 118 to the third side wall 16. In the event that a user opens the container 10 from the top, the internal top panel 24 includes a notch 120 along a free edge of the internal top panel 24 that allows a user to more easily grip the internal top panel 24 and rotate the internal top panel 24 along the foldable edge 118 so that the internal top panel is parallel 24 to the third side wall 16. The user can remove contents from the container 10 when the internal top panel 24 and the external top panel 20 are each moved to an open position. In the embodiment of FIG. 6, the internal top panel 24 has an overall width of slightly less than 16.3125 inches due to material being removed from the blank 60 to form the internal top panel 24, and an overall depth M of 11.3125 inches.

The external top panel 20 is connected by a foldable edge 122 to the first side wall 12. The external top panel 20 may be folded above the internal top panel 24, and the internal top panel 24 and the external top panel 20 are substantially perpendicular to the side walls 12, 14, 16, 18 when the container 10 is in the closed condition. In the embodiment of FIG. 6, the external bottom panel 20 has an overall width of slightly less than 16.125 inches due to material being removed from the blank 60 to form slots that define the external bottom panel 20, and an overall depth M of 11.3125 inches.

A container that has only the side walls 12, 14, 16, 18, internal top panel 24, external top panel 20, internal bottom panel 40, and the external bottom panel 22 described above would only have two total layers of material in a lateral direction and four total layers of material in a vertical direction when the container is in a closed condition. To improve the structural integrity of the container during shipping, the present disclosure provides internal support structures that provide additional layers of material from the single container blank. In the container blank 60 of FIG. 6, four internal support structures are included.

The first internal support structure 26 includes the first portion 36 that is connected by a foldable edge 124 to an upper end of the second side wall 14 and the second portion 38 that is connected to the first portion 36 by a foldable edge 126. When the container 10 is in the closed condition, the first portion 36 is in adjacent relation with the internal top panel 24, and the second portion 38 is in adjacent relation with the first portion 36. In particular, in the closed condition, the first portion 36 is between the second portion 38 and the internal top panel 24.

To provide lateral support, the first internal support structure 26 includes the first leaf 46 connected to the second portion 38 by a first foldable edge 128 and the second leaf 48 connected to the second portion 38 by a second foldable edge 130, the second foldable edge 130 being opposite the first foldable edge 128. When the container 10 is in the closed condition, each leaf 46, 48 is in adjacent relation with one of the side walls. In particular, the first leaf 46 of the first internal support structure 26 is in adjacent relation with the first side wall 12 and the second leaf 48 of the first internal support structure 26 is in adjacent relation with the third side wall 16 when the container is in the closed condition.

The second internal support structure 28 includes a first portion 134 that is connected by a foldable edge 136 to an upper end of the fourth side wall 18 and a second portion 138 that is connected by a foldable edge 140 to the first portion 134. When the container 10 is in the closed condition, the first portion 134 is in adjacent relation with the internal top panel 24, and the second portion 138 is in adjacent relation with the first portion 134. In particular, in the closed condition, the first portion 134 is between the second portion 138 and the internal top panel 24.

To provide lateral support, the second internal support structure 28 includes a first leaf 142 connected by a first foldable edge 144 to the second portion 138 and a second leaf 146 connected by a second foldable edge 148 to the second portion 138, the second foldable edge 148 being opposite the first foldable edge 144. When the container 10 is in the closed condition, each leaf 142, 146 is in adjacent relation with one of the side walls. In particular, the first leaf 142 of the second internal support structure 28 is in adjacent relation with the third side wall 16 and the second leaf 146 of the second internal support structure 26 is in adjacent relation with the first side wall 12 when the container 10 is in the closed condition.

The third internal support structure 32 includes the first portion 42 that is connected by a foldable edge 160 to a lower end of the second side wall 14 and the second portion 44 that is connected to the first portion 42 by a foldable edge 162. When the container 10 is in the closed condition, the first portion 42 is in adjacent relation with the internal bottom panel 40, and the second portion 44 is in adjacent relation with the first portion 42. In particular, in the closed condition, the first portion 42 is between the second portion 44 and the internal bottom panel 40.

To provide lateral support, the third internal support structure 32 includes the first leaf 50 connected by a first foldable edge 164 to the second portion 44 and the second leaf 52 connected by a second foldable edge 166 to the second portion 44, the second foldable edge 166 being opposite the first foldable edge 164. When the container 10 is in the closed condition, each leaf 50, 52 is in adjacent relation with one of the side walls. In particular, the first leaf 50 of the third internal support structure 32 is in adjacent relation with the first side wall 12 and the second leaf 52 of the third internal support structure 32 is in adjacent relation with the third side wall 16 when the container 10 is in the closed condition.

The fourth internal support structure 34 includes a first portion 170 that is connected by a foldable edge 172 to a lower end of the fourth side wall 18 and a second portion 174 that is connected to the first portion 170 by a foldable edge 176. When the container 10 is in the closed condition, the first portion 170 is in adjacent relation with the internal bottom panel 40, and the second portion 174 is in adjacent relation with the first portion 170 when the container 10 is in a closed condition. In particular, in the closed condition, the first portion 170 is between the second portion 174 and the internal bottom panel 40.

To provide lateral support, the fourth internal support structure 34 includes a first leaf 180 connected by a first foldable edge 182 to the second portion 174 and a second leaf 184 connected by a second foldable edge 186 to the second portion 174, the second foldable edge 186 being opposite the first foldable edge 182. When the container is in the closed condition, each leaf 180, 184 is in adjacent relation with one of the side walls. In particular, the first leaf 180 of the fourth internal support structure 174 is in adjacent relation with the third side wall 16 and the second leaf 184 of the fourth internal support structure 34 is in adjacent relation with the first side wall 12 when the container is in the closed condition.

According to another aspect of the present disclosure, a method of folding a blank to form the container is provided. The method may be performed using a container blank of the present disclosure, such as the container blank of FIG. 6.

First, the user folds the first side wall 12 relative to the second side wall 14 about the foldable edge 100, and folds the third side wall 16 relative to the fourth side wall 18 about the foldable edge 104, so that the first side wall 12 is in facing relation with the second side wall 14 and the third side wall 16 is in facing relation with the fourth side wall 18, as shown in FIG. 7. The user fastens the tab 106 to an inner surface of the first side wall 12.

The user folds the four side walls 12, 14, 16, 18 so the four side walls 12, 14, 16, 18 have a substantially square arrangement when viewed from above or below, as shown in FIG. 8.

Figure 10:
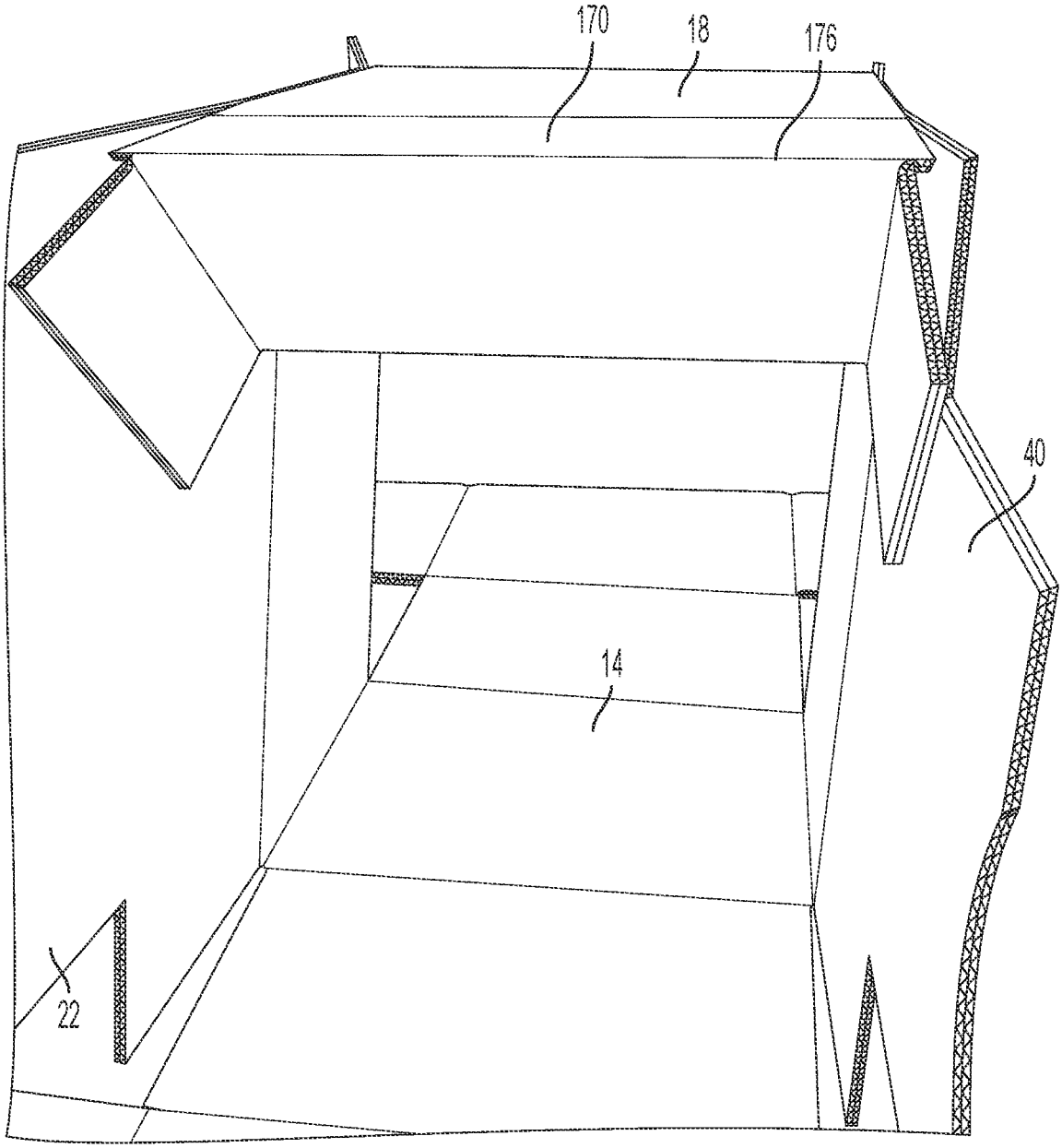
FIG. 10 is a perspective view of another step of forming a container from the container blank of FIG. 7.
Figure 11:
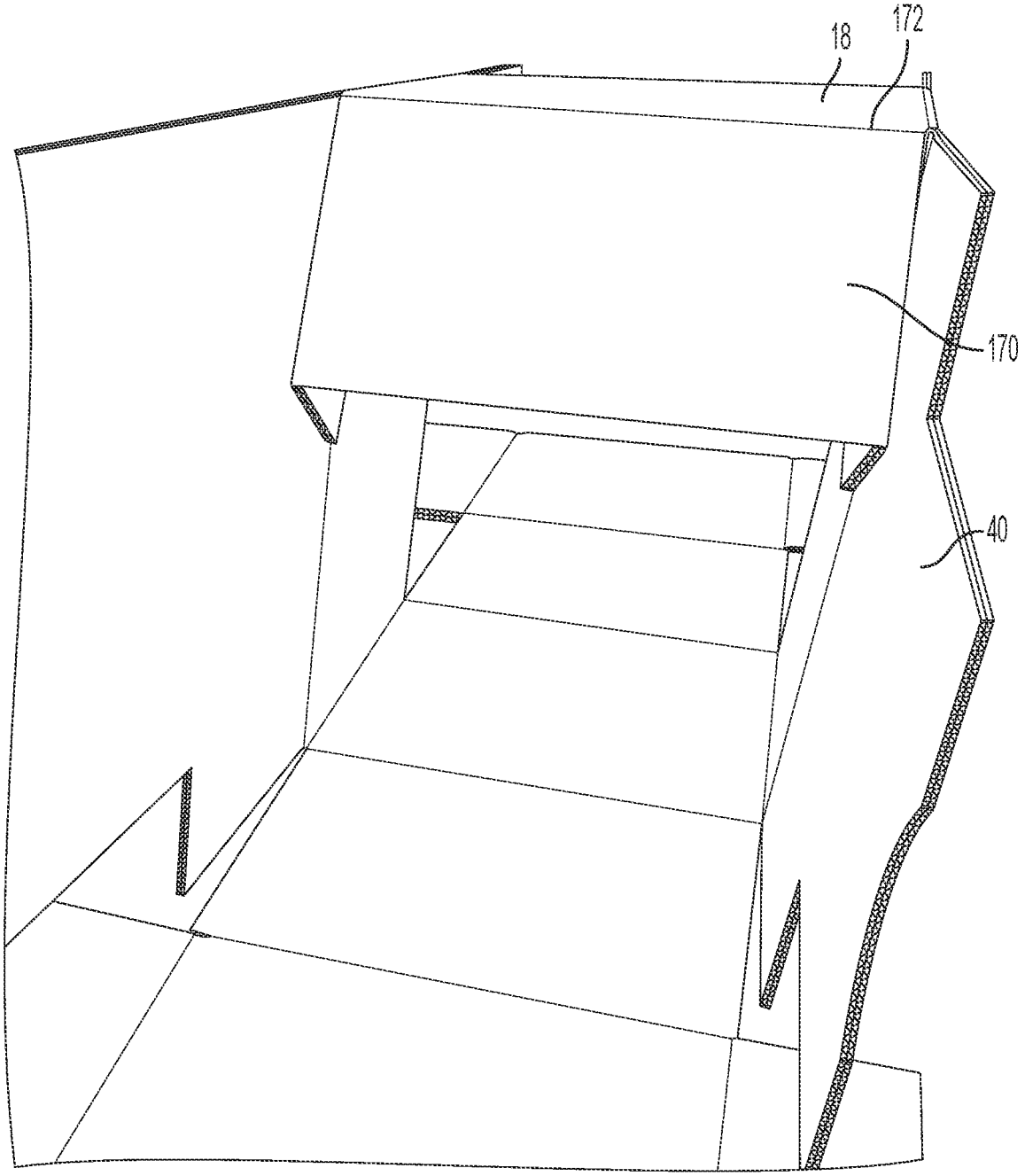
FIG. 11 is a perspective view of another step of forming a container from the container blank of FIG. 7.

As shown in FIGS. 9-12, the user folds the leaves 180, 184 of the fourth support structure 34 relative to the second portion 174 of the fourth support structure 34. Then the user folds the second portion 174 relative to the first portion 170 of the fourth support structure 34 about foldable edge 176, as shown in FIG. 10. As shown in FIG. 11, the user folds the first portion 170 of the fourth support structure 34 along the foldable edge 172 so the first portion 170 is perpendicular to the fourth side wall 18. In this configuration, the leaves 180, 184 extend substantially upwardly within the container when the container is oriented upright.

Figure 12:
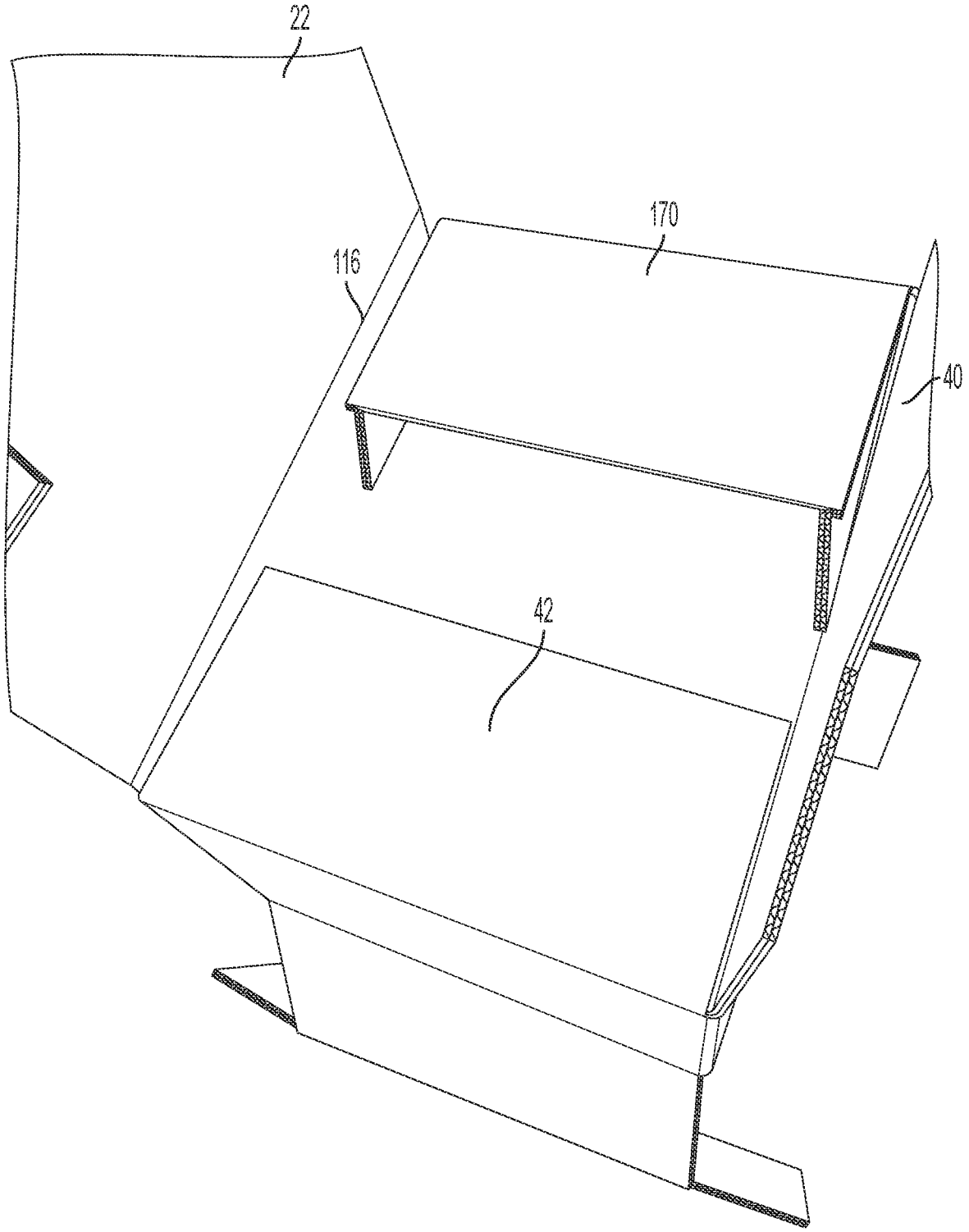
FIG. 12 is a perspective view of another step of forming a container from the container blank of FIG. 7.

The user folds the leaves 50, 52 of the third support structure 32 relative to the second portion 44 of the third support structure 32. The user folds the second portion 44 relative to the first portion 42 of the third support structure 32. The user folds the first portion 42 of the third support structure 32 along the foldable edge 160 so the first portion 42 is perpendicular to the second side wall 14, and the leaves 50, 52 extend substantially upwardly within the container. In FIG. 12, the first portion 42 of the third support structure 32 and the first portion 170 of the fourth support structure 34 are substantially perpendicular to the four side walls 12, 14, 16, 18.

Figure 13:
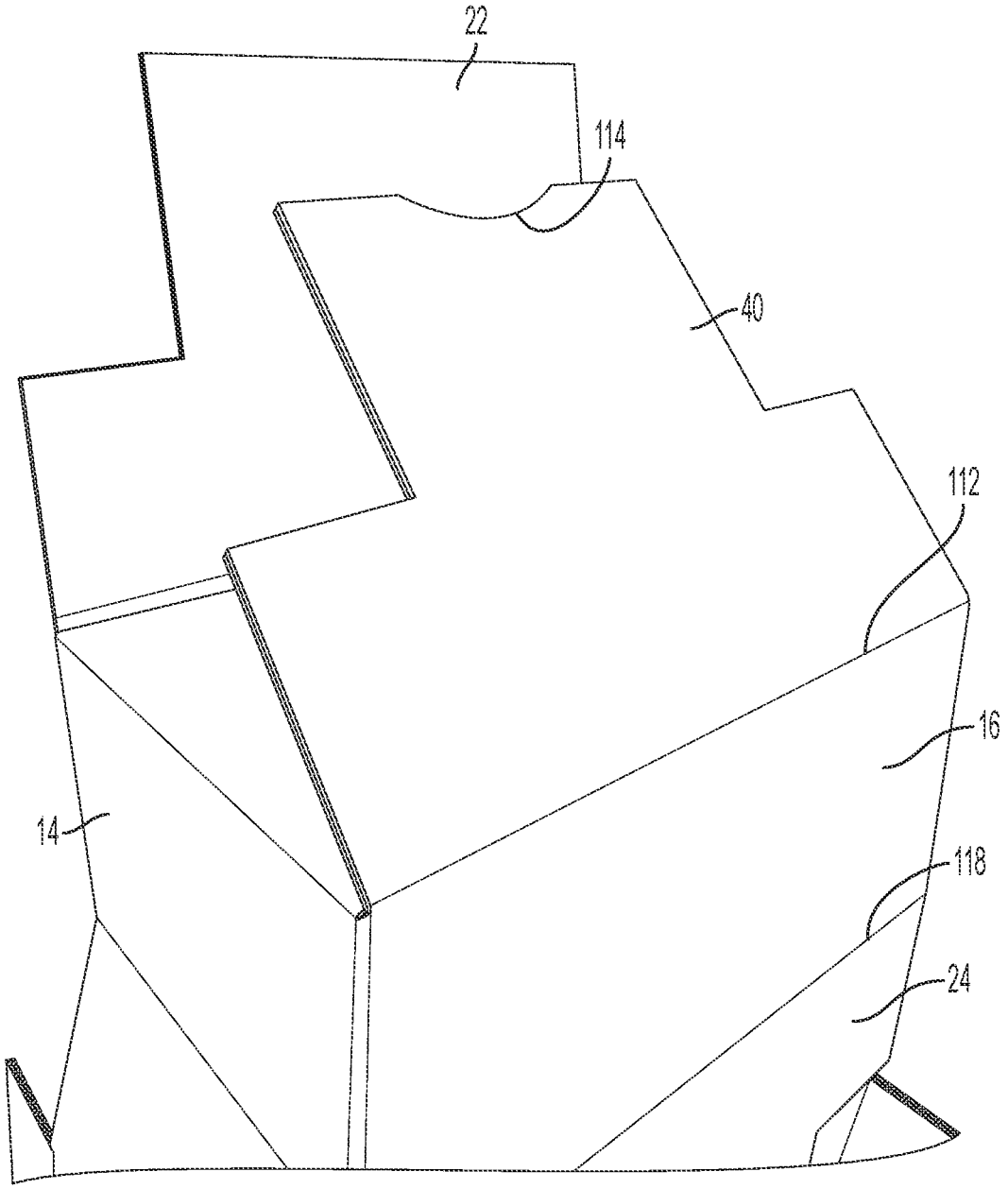
FIG. 13 is a perspective view of another step of forming a container from the container blank of FIG. 7.
Figure 14:
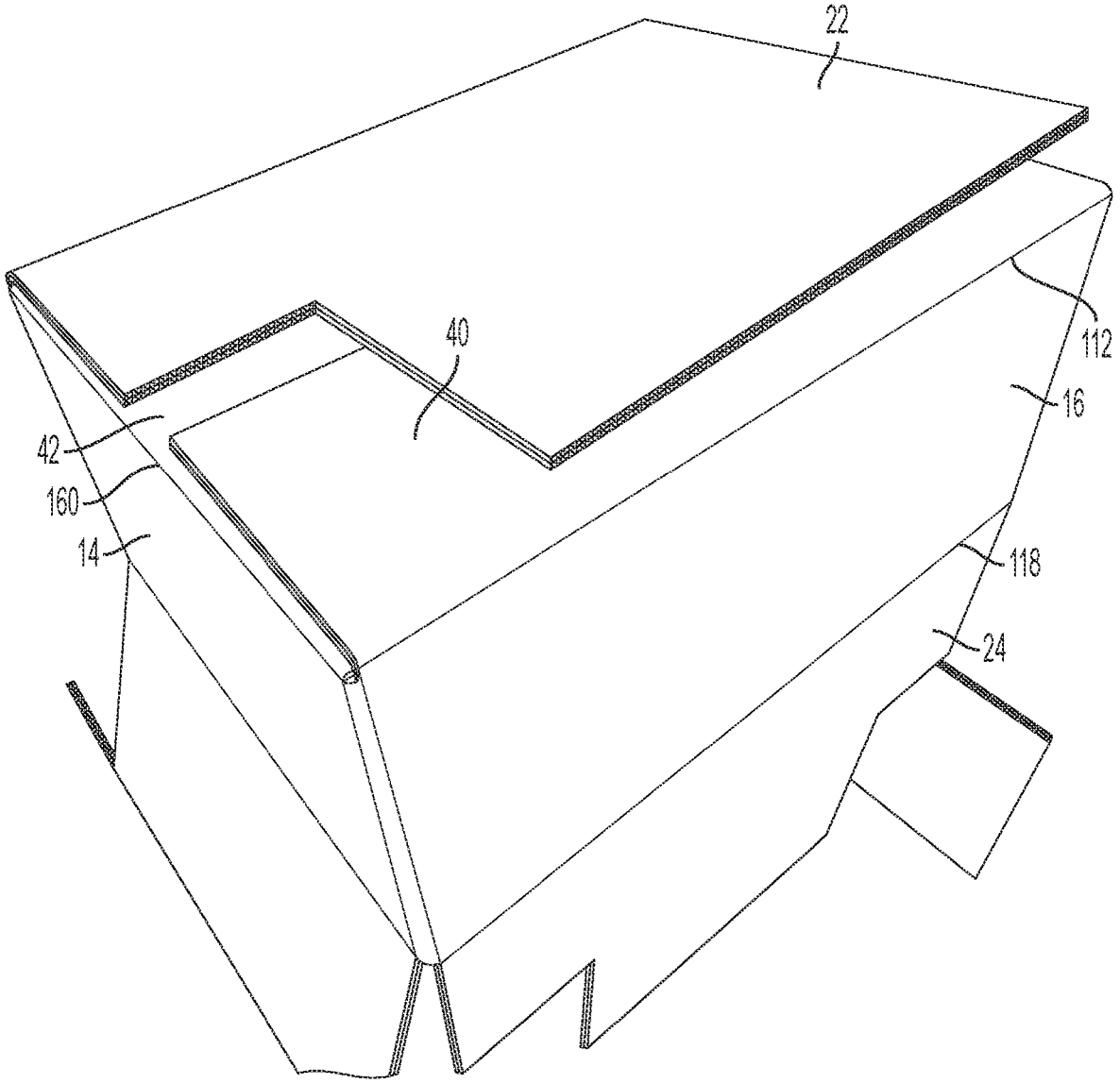
FIG. 14 is a perspective view of another step of forming a container from the container blank of FIG. 7.

As shown in FIG. 13, the user folds the internal bottom wall 40 along foldable edge 112. The user rotates the internal bottom wall 40 along the foldable edge 112 so that the internal bottom wall 40 is perpendicular to the side walls 12, 14, 16, 18. The user folds the external bottom wall 22 so the external bottom wall 22 is in adjacent facing relation with the internal bottom wall 40, as shown in FIG. 14. The user may use a fastener to secure the external bottom wall 22 in place. For example, the user may apply adhesive between the internal bottom wall 40 and the external bottom wall 22 and/or may apply tape that extends over the external bottom wall 22 and the second side wall 14, the third side wall 16, and/or the fourth side wall 18.

Figure 15:
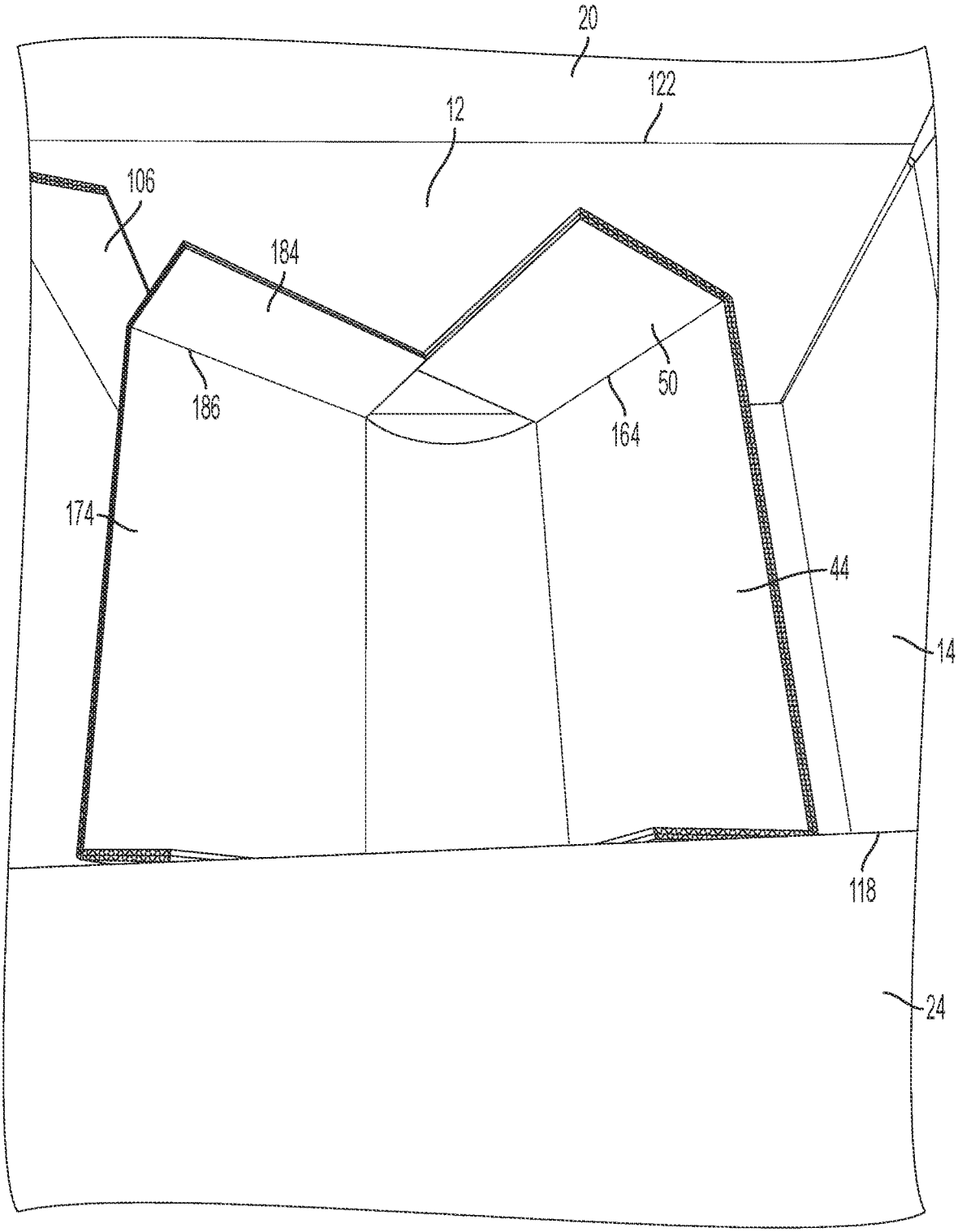
FIG. 15 is a perspective view of another step of forming a container from the container blank of FIG. 7.

With the bottom of the container formed, the user turns the container upright, as shown in FIG. 15. The leaf 184 of the fourth support structure 34 and the leaf 50 of the third support structure 32 are in adjacent facing relation with the first side wall 12.

Figure 16:
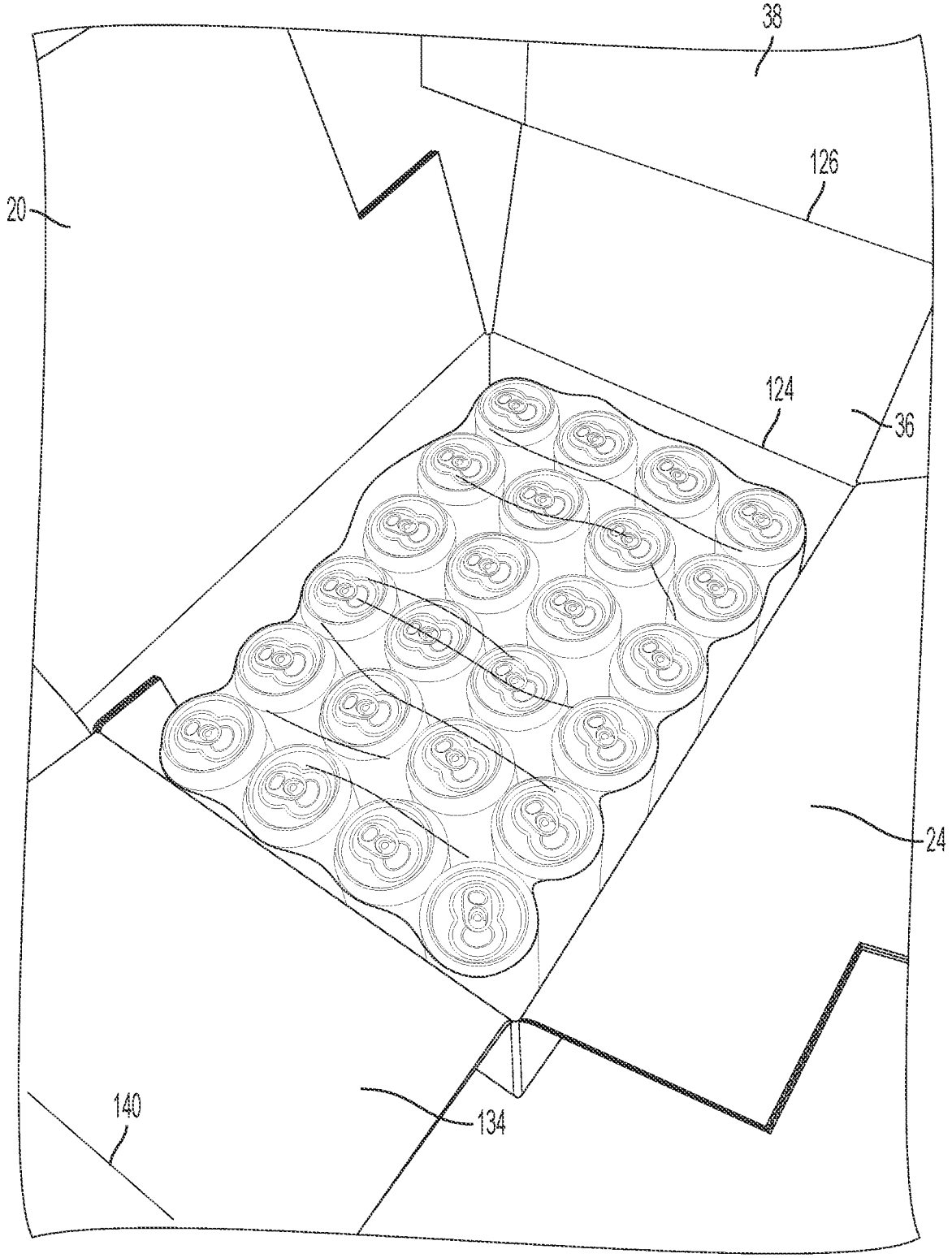
FIG. 16 is a perspective view of another step of forming a container from the container blank of FIG. 7.

The user may place a product 30 into the container, as shown in FIG. 16. The product 30 rests on the second portion 44 of the third support structure 32 and the second portion 174 of the fourth support structure 34.

Figure 17:
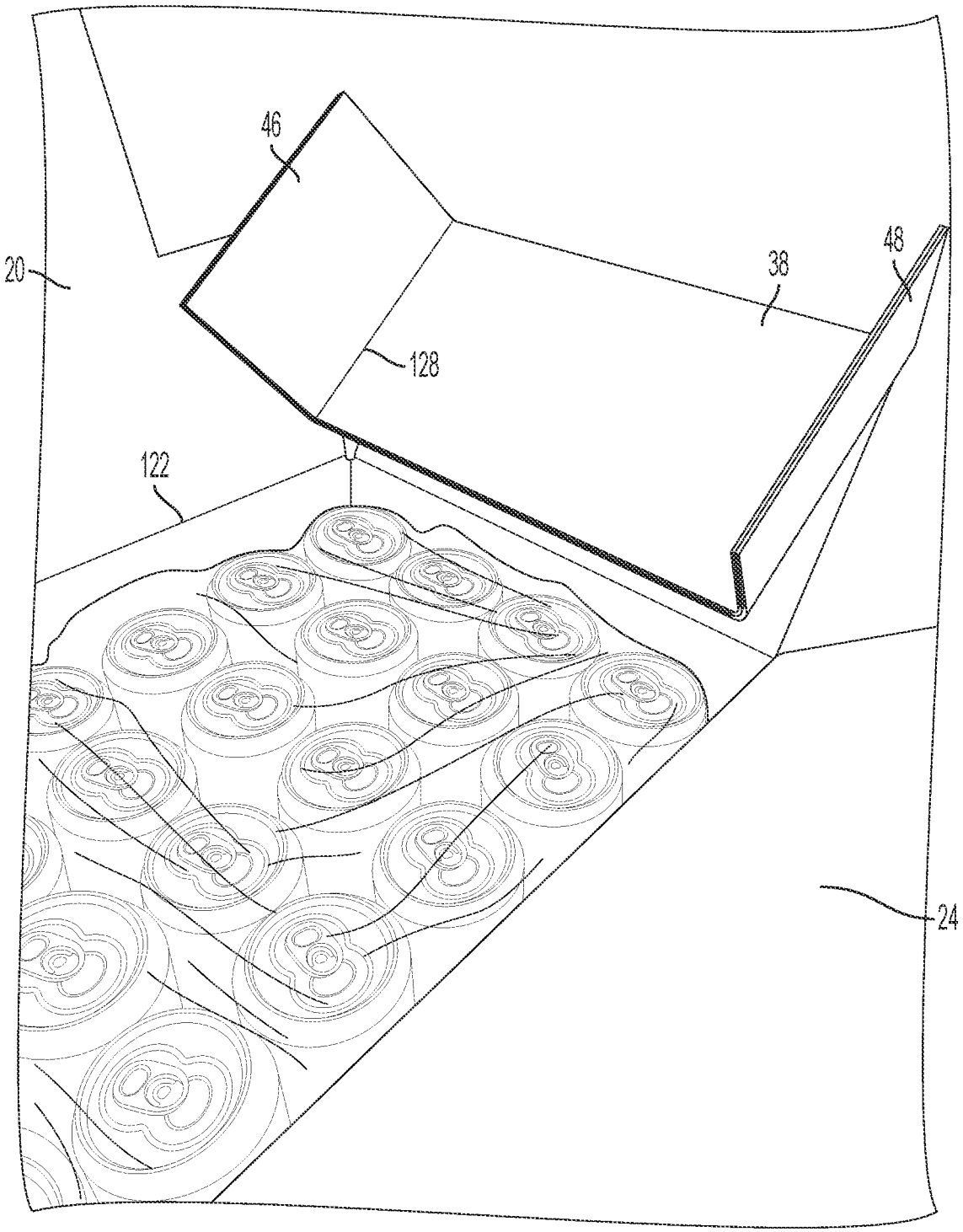
FIG. 17 is a perspective view of another step of forming a container from the container blank of FIG. 7.

The user begins to close the container. The process for closing the upper end of the container is similar to the process for closing the lower end of the container. The user folds the leaves 46, 48 of the first support structure 26 relative to the second portion 38 of the first support structure 26, as shown in FIG. 17, and folds the leaves 142, 146 of the second support structure 28 relative to the second portion 138 of the second support structure 28.

Figure 18:
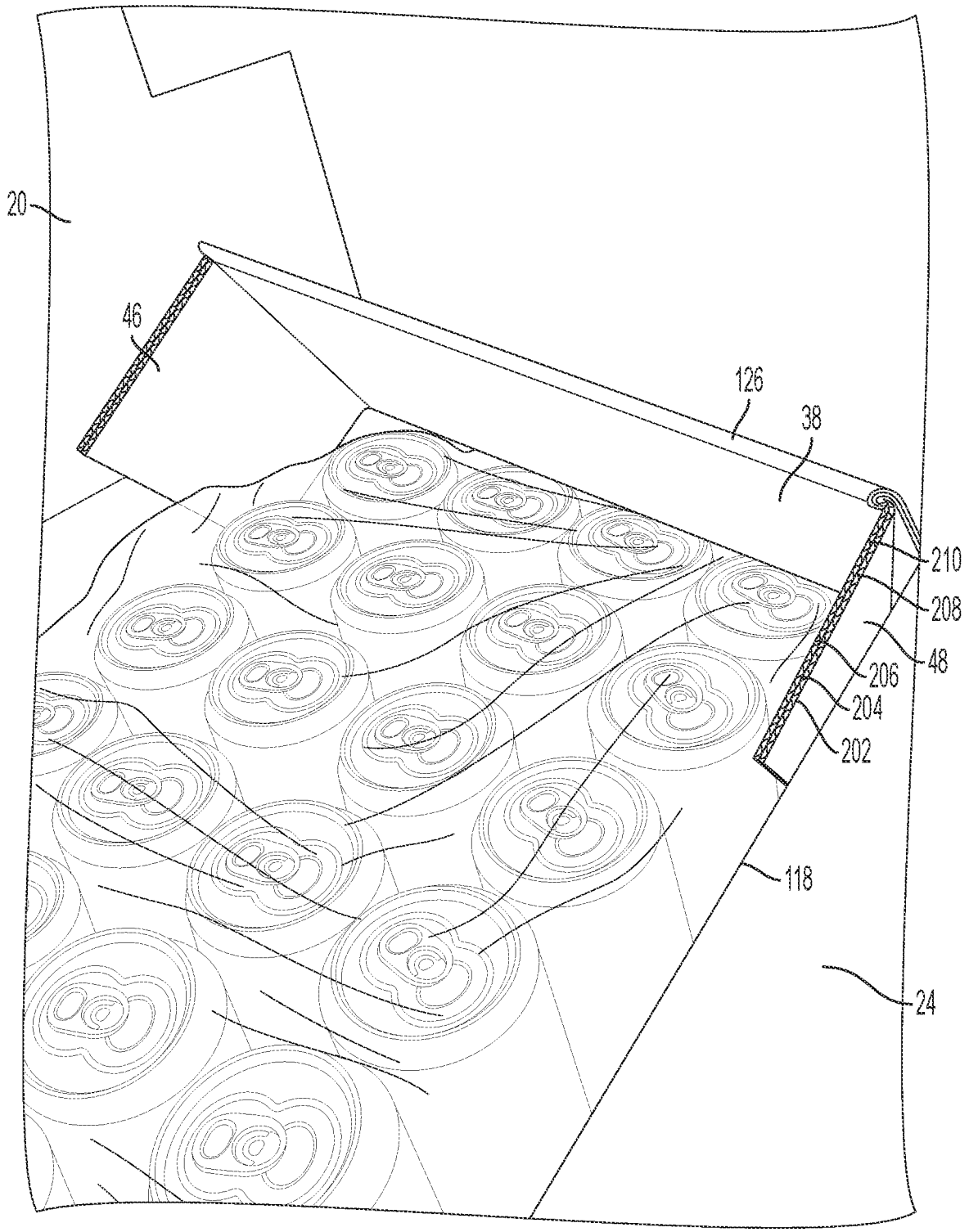
FIG. 18 is a perspective view of another step of forming a container from the container blank of FIG. 7.

As shown in FIG. 18, the user folds the first support structure 26 and the second support structure 28. The user folds the first portion 36 and second portion 38 of the first support structure 26 relative to each other along foldable edge 126. The user folds the first portion 134 and second portion 138 of the second support structure 28 relative to each other along the foldable edge 140. The user folds the first portion 36 of the first support structure 26 with respect to the adjacent third side wall 14 along the foldable edge 124, and folds the first portion 134 of the second support structure 28 with respect to the fourth side wall 18 along the foldable edge 136.

Figure 19:
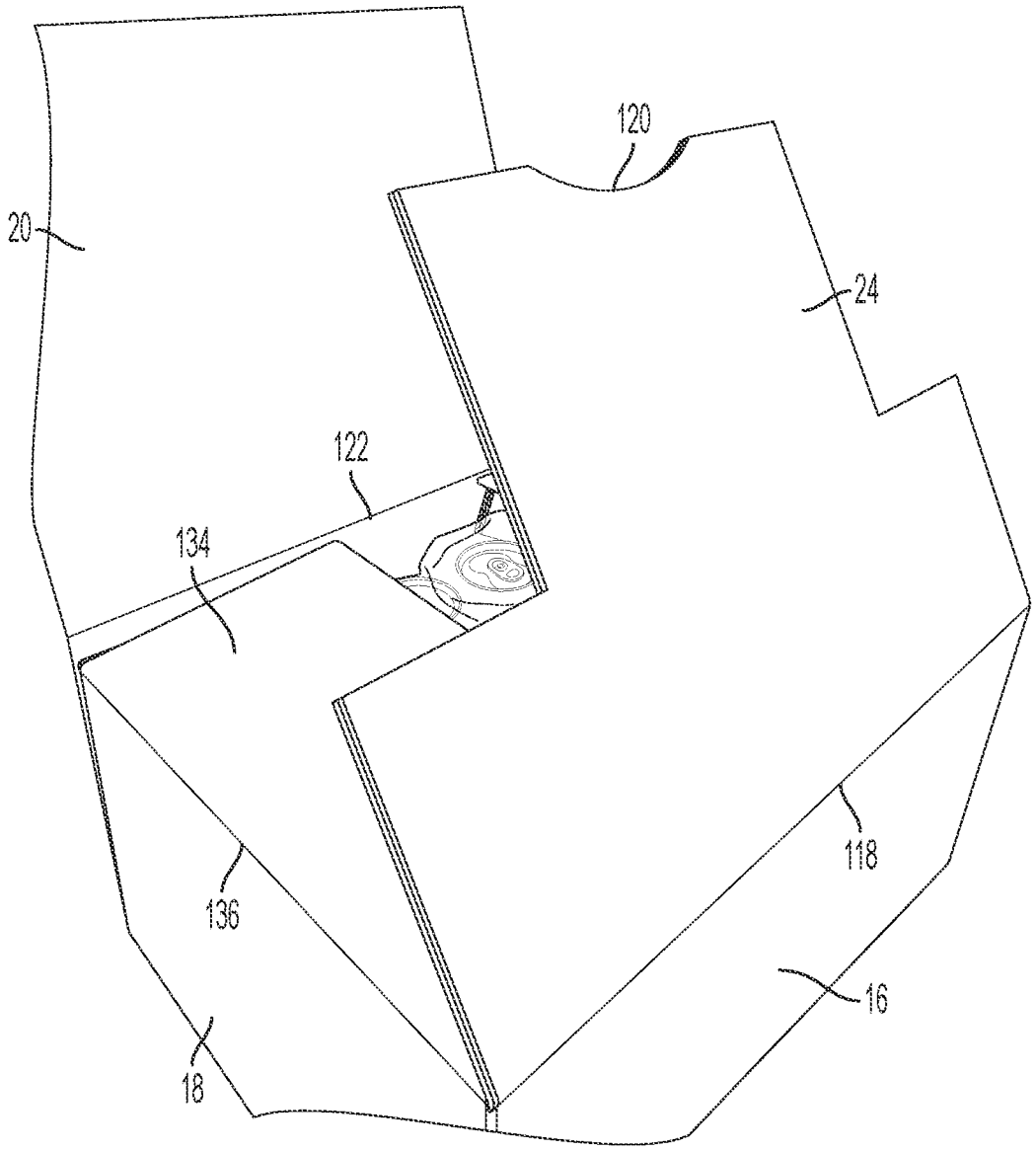
FIG. 19 is a perspective view of another step of forming a container from the container blank of FIG. 7.

In FIG. 19, the user has rotated the first portion 36, 134 of each of the first and second support structures 26, 28 relative to its adjacent sidewall along respective fold lines. The leaves 46, 48, 142, 146 of the respective first and second support structures 26, 28 extend downwardly within the container between the product 30 and the adjacent side wall of the container.

Figure 20:
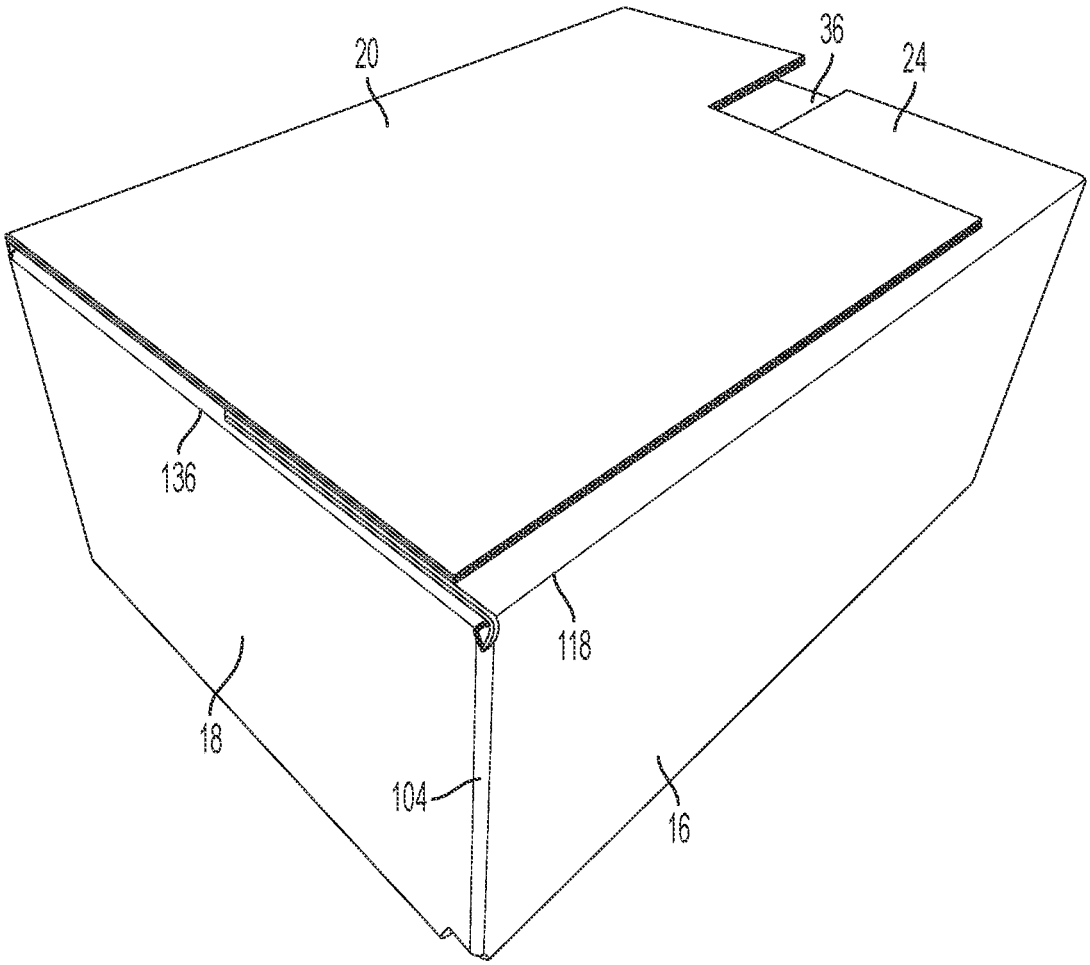
FIG. 20 is a perspective view of another step of forming a container from the container blank of FIG. 7.

The user may close the upper end of the container 10. To close the upper end of the container, the user folds the internal top wall 24 along the adjacent foldable edge 118. The user folds the external top wall 20 along the adjacent foldable edge 122 so the bottom of the external top wall 20 is in adjacent facing relation with the upper surface of the internal top wall 24, as shown in FIG. 20. The user may use a fastener to secure the external top wall 20 in place. For example, the user may apply adhesive between the internal top wall 24 and the external top wall 20 and/or may apply tape that extends over the external top wall 20 and the second side wall 14, the third side wall 16, and/or the fourth side wall 18.

When the container is in the closed condition, the first portion 36, 134 f each of the first and second support structures 26, 28 is in adjacent relation with the internal top wall 24 and the respective second portion 38, 138 of each of the first and second internal support structures 26, 28 is in adjacent relation with the product 30.

According to another aspect of the present disclosure, a method of forming a container blank is provided. In one embodiment, the method of forming a container blank includes forming a container blank 60 of FIG. 6. The method may be performed by cutting a piece of material to have a rectangular outer shape that measures about 57.8125 inches by about 30.875 inches. Material is removed to form two cutouts 190, 192 on one of the short edges of the rectangle. The first cutout 190 separates the tab 106 from the leaf 146 of the second support structure 28. The second cutout 192 separates the tab 106 from the leaf 184 of the fourth support structure 34.

Slots 62, 68, 74, 80, 86, 92 are cut in the container blank 60 to define the external top panel 20, the internal top panel 24, the external bottom panel 22, the internal bottom panel 40, and the four support structures 26, 28, 32, 24. Cutouts 190, 192 are cut into the container blank 60 to define the tab 106 and leaves 146, 184. The slots 62, 68, 74, 80, 86, 92 and the cutouts 190, 192 are arranged such that the overall waste of the sheet that forms the container blank 60 is minimized. The overall waste may be calculated as a percentage of material removed from the rectangular outer shape of the blank. In the embodiment of FIG. 6, the overall waste of the sheet that forms the container blank 10 is 3.65%.

Foldable edges 100, 102, 104, 108, 112, 116, 118, 122, 124, 126, 128, 130, 136, 140, 144, 148, 160, 162, 164, 166, 172, 176, 182, 186 are defined in the container blank 60. Each foldable edge may be formed by creasing the container blank along the foldable edge, narrowing the material of the container blank along the length of the foldable edge, perforating the container blank along the length of the foldable edge, or otherwise causing the container blank to be biased to fold along the length of the respective foldable edge.

In some embodiments, the container blank is formed from a piece of material that comprises corrugated cardboard. In the Figures, the container 10 is shown as being formed from a container blank 60 that is a 5-ply corrugated linerboard and medium. An edge view of the 5-ply corrugated linerboard and medium is visible, for example, on the leaf 48 of the first internal support structure 26 in FIG. 18. The 5-ply corrugated linerboard and medium includes a first liner 202, a second liner 204, and a third liner 206. In some embodiments, the first liner 202, the second liner 204, and the third liner 206 are at least substantially planar and at least substantially parallel to each other. A first fluted corrugating medium 208 is positioned between the first liner 202 and the second liner 204. The first fluted corrugating medium 208 is adhered to each of the first liner 202 and the second liner 204. A second fluted corrugating medium 210 is positioned between the second liner 204 and the third liner 206. The second fluted corrugating medium 210 is adhered to each of the second liner 204 and the third liner 206. The 5-ply corrugated linerboard and medium is a double-layered corrugated structure.

As noted above, in some embodiments, the blank is formed from a piece of material that is a 3-ply corrugated linerboard and medium. A 3-ply corrugated linerboard and medium includes a first liner, a second liner that extends parallel to the first liner, and a medium positioned between and adhered to the first liner and the second liner.

In some embodiments, the container blank is formed from another type of corrugated cardboard.

In some embodiments, the corrugated cardboard is fluted corrugated cardboard. In other embodiments, another type of appropriate corrugating material can be used.

In any of the embodiments described herein, a fastener may include an adhesive, one or more staple, tape, or another fastener.

The aspects disclosed herein in accordance with the present disclosure, are not limited in their application to the details of construction and the arrangement of components set forth in the following description or illustrated in the accompanying drawings. These aspects are capable of assuming other embodiments and of being practiced or of being carried out in various ways. Examples of specific implementations are provided herein for illustrative purposes only and are not intended to be limiting. In particular, acts, components, elements, and features discussed in connection with any one or more embodiments are not intended to be excluded from a similar role in any other embodiments.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. In addition, in the event of inconsistent usages of terms between this document and documents incorporated herein by reference, the term usage in the incorporated reference is supplementary to that of this document; for irreconcilable inconsistencies, the term usage in this document controls.

Having thus described several aspects of at least one example, it is to be appreciated that various alterations, modifications, and improvements will readily occur to those skilled in the art. For instance, examples disclosed herein may also be used in other contexts. Such alterations, modifications, and improvements are intended to be part of this disclosure, and are intended to be within the scope of the examples discussed herein. Accordingly, the foregoing description and drawings are by way of example only.

What is claimed is:

1. A foldable container blank comprising:

four side walls;

a top panel foldably connected to a first side wall of the four side walls;

a bottom panel foldably connected to the first side wall; and a first fold line connecting the first side wall to a second side wall of the four side walls;

a second fold line connecting the second side wall to a third side wall of the four side walls;

a third fold line connecting the third side wall to a fourth side wall of the four side walls;

at least one internal support structure connected to one of the second side wall and the fourth side wall and including:

a first portion that is in adjacent relation with one of the top panel and the bottom panel when the container is in a closed condition, a second portion that is in adjacent facing relation with the first portion when the container is in the closed condition, and at least one leaf connected to the second portion of the respective internal support structure by a foldable edge, the foldable edge extending between the first portion and an opposing edge of the second portion, the at least one leaf extending laterally away from the second portion beyond one of a folding axis of the first fold line and a folding axis of the third fold line, wherein the top panel folds over one of the at least one internal support structure.

2. The container blank of claim 1, wherein the first portion is between the second portion and the top panel when the container is in the closed condition.

3. The container blank of claim 1, each leaf being in adjacent relation with one of the side walls when the container is in the closed condition.

4. The container blank of claim 1, wherein the at least one internal support structure includes:

a first internal support structure and a second internal support structure each secured to one of the side walls, and a third internal support structure and a fourth internal support structure each secured to another one of the side walls.

5. The container blank of claim 4, each leaf being in adjacent relation with one of the side walls when the container is in the closed condition.

6. The container blank of claim 4, the at least one leaf of the first internal support structure including a first leaf secured to a first foldable edge of the second portion, the first leaf being in adjacent relation with the first side wall when the container is in the closed condition, and the first internal support structure further including a second leaf secured to a second foldable edge of the second portion, the first edge being opposite the second edge, the second leaf being in adjacent relation with a third side wall of the four side walls, the third side wall being opposite the first side wall when the container is in the closed condition.

7. The container blank of claim 6, wherein the side walls, the top panel, the bottom panel, and the at least one internal support structure are formed of a single piece of material.

8. The container blank of claim 1, wherein the side walls, the top panel, the bottom panel, and the at least one internal support structure are formed of a single piece of material.

9. The container blank of claim 8, wherein the single piece of material has a substantially rectangular shape when unfolded.

10. The container blank of claim 1, wherein the top panel includes a notch.

11. The container blank of claim 1, further comprising an external top panel that folds over the top panel when the container is the closed condition.

12. The container blank of claim 1, further comprising an external bottom panel that folds beneath the bottom panel when the container is in the closed condition.

13. The container blank of claim 1, further comprising a tab connected to one of the side walls, the tab being securable to another one of the side walls when the container is in the closed condition.

14. The container blank of claim 1, wherein the container blank is made from a 5-ply cardboard material.

15. A shipping container fabricated from the foldable container blank of claim 1.

16. The shipping container of claim 15, wherein the blank is a unitary blank of cardboard material.

17. A method of forming a container blank comprising cutting a piece of material to have:

four side walls;

a top panel foldably connected to a first one of the side walls;

a bottom panel foldably connected to the first one of the side walls;

a first fold line connecting the first one of the side walls to a second one of the side walls;

at least one internal support structure connected to the second one of the side walls and including:

a first portion that is in adjacent relation with the top panel when the container is in a closed condition, a second portion that is in adjacent relation with the first portion when the container is in the closed condition, and at least one leaf connected to the second portion of the respective internal support structure by a foldable edge, the foldable edge extending between the first portion and an opposing edge of the second portion, the at least one leaf extending laterally away from the second portion beyond a folding axis of the first fold line, wherein the top panel is configured to be folded over one of the at least one internal support structure.

18. The method of claim 17, further comprising:

creasing an edge between the top panel and the first one of the side walls;

creasing an edge between the bottom panel and the first one of the side walls; and creasing an edge between the at least one internal support structure and the second one of the side walls.

19. A method of assembling a foldable container comprising:

providing a blank having four side walls including a first side wall and a second side wall, the blank having a first fold line connecting the first side wall to the second side wall;

folding the four side walls so the four side walls have a substantially square arrangement when viewed from above;

folding a bottom panel that is foldably connected to the first side wall so that the bottom panel is perpendicular to the first side wall; and folding at least one internal support structure connected to the second side wall and folding a top panel that is connected to the first side wall over one of the at least one internal support structure so that a first portion of the one of the at least one internal support structure is in adjacent relation with and internally positioned relative to the top panel when the container is in a closed condition a second portion of the one of the at least one internal support structure is in adjacent relation with the first portion when the container is in the closed condition; and folding at least one leaf connected to the second portion of the respective internal support structure by a foldable edge, the foldable edge extending between the first portion and an opposing edge of the second portion, the at least one leaf extending laterally away from the second portion beyond a folding axis of the first fold line when in blank form, wherein the step of folding the at least one leaf results in the at least one leaf being adjacent to the first side wall.

* * * * *